US010395824B2

(12) United States Patent
Hasegawa

(10) Patent No.: US 10,395,824 B2
(45) Date of Patent: Aug. 27, 2019

(54) METHOD OF MANUFACTURING WINDING-TYPE COIL COMPONENT

(71) Applicant: MURATA MANUFACTURING CO., LTD., Kyoto-fu (JP)

(72) Inventor: Shin Hasegawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 348 days.

(21) Appl. No.: 15/361,833

(22) Filed: Nov. 28, 2016

(65) Prior Publication Data

US 2017/0076861 A1 Mar. 16, 2017

Related U.S. Application Data

(63) Continuation of application No. PCT/JP2015/063640, filed on May 12, 2015.

(30) Foreign Application Priority Data

May 30, 2014 (JP) ..... 2014-112945

(51) Int. Cl.

| | |
|---|---|
| ***H01F 27/29*** | (2006.01) |
| ***H01F 41/09*** | (2016.01) |
| ***H01F 41/10*** | (2006.01) |
| ***H01F 41/064*** | (2016.01) |

(52) U.S. Cl.

CPC ..... *H01F 41/064* (2016.01); *H01F 41/09* (2016.01); *H01F 41/10* (2013.01); *H01F 27/29* (2013.01)

(58) Field of Classification Search

CPC ..... H01F 41/064; H01F 41/09; H01F 41/10; H01F 27/29; H01F 27/292

See application file for complete search history.

(56) References Cited

U.S. PATENT DOCUMENTS 6,480,083 B1 * 11/2002 Toi ..... H01F 17/045 336/192

FOREIGN PATENT DOCUMENTS

| | | | |
|---|---|---|---|
| JP | H09-219333 | A | 8/1997 |
| JP | H10-135048 | A | 5/1998 |
| JP | 2001-017903 | A | 1/2001 |
| JP | 2001-068343 | A | 3/2001 |
| JP | 3771308 | B2 | 4/2006 |
| JP | 2007-012861 | A | 1/2007 |

OTHER PUBLICATIONS

International Search Report issued in PCT/JP2015/063640; dated Jul. 28, 2015.

Written Opinion issued in PCT/JP2015/063640; dated Jul. 28, 2015.

International Preliminary Report on Patentability issued in PCT/JP2015/063640; dated Dec. 6, 2016.

* cited by examiner

*Primary Examiner* — Livius R. Cazan

(74) *Attorney, Agent, or Firm* — Studebaker & Brackett PC

(57) ABSTRACT

A method of manufacturing a winding-type coil component which can efficiently manufacture a winding-type coil component having external electrodes where a height of the external electrodes is gradually increased in an inclined manner from opposedly facing surfaces of one flange portion and the other flange portion to surfaces of the one flange portion and the other flange portion on a side opposite to the opposedly facing surfaces.

20 Claims, 16 Drawing Sheets

31
R1(15)
3a
1
11
Rotated 0°

31
R1(15)
3a
1
11
Rotated 45°

31
R1(15)
3a
1
11
Rotated 90°

31
3a
R1(15)
1
11
Rotated 135°

31
3a
R1(15)
1
11
Rotated 180°

METHOD OF MANUFACTURING WINDING-TYPE COIL COMPONENT

CROSS REFERENCE TO RELATED APPLICATIONS

This application claims benefit of priority to Japanese Patent Application 2014-112945 filed May 30, 2014, and to International Patent Application No. PCT/JP2015/063640 filed May 12, 2015, the entire content of which is incorporated herein by reference.

TECHNICAL FIELD

The present disclosure relates to a method of manufacturing a coil component, and more particularly to a method of manufacturing a winding-type coil component which includes: a core member having a columnar winding core portion and a pair of flange portions which is formed on both ends of the winding core portion; a pair of external electrodes formed on one flange portion and the other flange portion of the pair of flange portions; and a winding wound on the winding core portion.

BACKGROUND

Japanese Patent No. 3771308 proposes a method of manufacturing a winding-type coil component shown in FIG. 15, for example.

A winding-type coil component 100 shown in FIG. 15 whose manufacturing method is proposed in Japanese Patent No. 3771308 includes: a core member 101 having a columnar winding core portion 102 and a pair of flange portions 103 (one flange portion 103*a*, the other flange portion 103*b*) which is formed on both ends of the winding core portion 102; a pair of external electrodes 104*a*, 104*b* formed on the pair of flange portions 103 (one flange portion 103*a*, the other flange portion 103*b*); and a winding 105 wound on the winding core portion. In such a configuration, the external electrodes 104*a*, 104*b* are formed in regions of the one flange portion 103*a* and the other flange portion 103*b* near an object (for example, a printed circuit board or the like) on which the winding-type coil component 100 is mounted.

Further, the external electrodes 104*a*, 104*b* are formed as follows so as to prevent the occurrence of drawbacks such as lowering of a characteristic such as a magnetic field and rounding around of solder to the coil (the winding 105). The electrodes are not formed on an opposedly-facing surface (inner wall surface) of the one flange portion 103*a* and an opposedly-facing surface (inner wall surface) of the other flange portion 103*b*, while the external electrodes 104*a*, 104*b* are formed such that heights of the formed external electrodes 104*a*, 104*b* are increased toward end surface sides (outer wall surfaces) from the opposedly-facing surface sides of the one flange portion 103*a* and the other flange portion 103*b*.

Japanese Patent No. 3771308 also describes that, in the manufacture of the winding-type coil component shown in FIG. 15, a method of forming an inclined external electrode shown in FIG. 16 is adopted as a method of forming the above-mentioned external electrodes (hereinafter referred to as "inclined external electrodes"). The method includes the steps of: applying by coating a conductive paste to the pair of flange portions 103 (the one flange portion 103*a*, the other flange portion 103*b*) by immersing a core member (ferrite core) 101 in a bath 109 in which a conductive paste 108 for forming the external electrodes is pooled; and firing the conductive paste.

As shown in FIG. 17, Japanese Patent Application Laid-Open No. 10-135048 discloses a winding-type coil component 200 where a conductive line 212 is wound on a winding core portion 211*c* of a core member 211, external electrodes 213*a*, 213*b* are formed on leg portions 211*a*, 211*b* on both end sides of the core member 211, and heights of the formed external electrodes 213*a*, 213*b* are increased toward end surface sides (outer wall surfaces) from opposedly-facing surface sides of the pair of leg portions 211*a*, 212*b*. Further, as a method of manufacturing the winding-type coil component 200 where external electrodes are formed in an inclined manner, a method shown in FIG. 18 is proposed where the external electrodes 213*a*, 213*b* are simultaneously formed on the pair of leg portions 211*a*, 211*b*.

That is, in Japanese Patent Application Laid-Open No. 10-135048, to apply a conductive paste by coating for simultaneously forming the external electrodes 213*a*, 213*b* on the pair of leg portions 211*a*, 211*b*, first, the core members 211 are placed on a flat jig 230 with the leg portions 211*a*, 211*b* directed upward. On the other hand, a plate 231 having V-shaped recessed portions 231*a* is prepared, and a conductive paste 232 for forming external electrodes is applied to the plate 231 by coating.

Then, the paste 232 applied to the plate 231 by coating is pressed to the core members 211 such that each recessed portion 231*a* of the plate 231 agrees with the core member 211 thereby the conductive paste is applied by coating to the pair of leg portions 211*a*, 211*b* simultaneously. Subsequently, a step of firing the conductive paste is performed so that the external electrodes 213*a*, 213*b* are formed on the leg portions 211*a*, 211*b*.

However, in the case of the above-mentioned method described in Japanese Patent No. 3771308, it is necessary to apply the conductive paste to one flange portion by coating and, thereafter, necessary to rotate (revolve) the core member to apply the conductive paste to the other flange portion by coating. In this case, however, it is necessary to perform the applying of the conductive paste as follows. The core members are held one by one or a plurality of core members are held in every row simultaneously, a conductive paste is applied by coating to one flange portion and, thereafter, the core member is inclined (rotated) to a reverse side, and the other flange portion is immersed in a conductive paste. Accordingly, the number of core members which can be processed at a time is small thus giving rise to a drawback that a manufacturing cost is pushed up.

In the case of the above-mentioned method described in Japanese Patent Application Laid-Open No. 10-135048, the conductive paste 232 is applied by coating the pair of leg portions 211*a*, 211*b* simultaneously. However, from drawbacks such as formability of an electrode material, working accuracy of jigs and positional accuracy of a core member, compared to the case where the conductive paste is applied to the pair of leg portions 211*a*, 211*b* one by one thus giving rise to a drawback that coating accuracy is lowered and form accuracy of the external electrode is lowered.

SUMMARY

Problem to be Solved by the Disclosure

The present disclosure has been made to solve the above-mentioned problem, and it is an object of the present disclosure to efficiently manufacture a highly reliable winding-type coil component having favorable properties and equipped with inclined external electrodes having high form accuracy, the winding-type coil component includes: a core member having one flange portion and the other flange portion; and external electrodes (inclined external electrodes) which are inclined such that a height of the external electrodes is gradually increased in an inclined manner from opposedly facing surfaces of the one flange portion and the other flange portion to surfaces of the one flange portion and the other flange portion on a side opposite to the opposedly facing surfaces.

Means for Solving the Problem

To solve the above-mentioned problem, according to the present disclosure, there is provided a (first) method of manufacturing a winding-type coil component which includes: a core member having a columnar winding core portion and a pair of flange portions which is formed on both ends of the winding core portion; a pair of external electrodes formed on one flange portion and the other flange portion of the pair of flange portions; and a winding wound on the winding core portion, wherein the external electrodes are formed on regions of the one flange portion and the other flange portion near an object on which the winding-type coil component is to be mounted such that a height of the external electrodes is gradually increased in an inclined manner from opposedly facing surfaces of the one flange portion and the other flange portion to surfaces of the one flange portion and the other flange portion on a side opposite to the opposedly facing surfaces, wherein a step of forming the external electrodes includes:

(a) a holding step of holding the core member by a first holding jig having a holding force for holding a plurality of the core members in a posture where an axis of the winding core portion has a predetermined angle with respect to a holding surface which is a main surface of the first holding jig on a side where the core member is held, and a region of the one flange portion where the external electrode is to be formed projects more from the holding surface of the first holding jig than the other flange portion, (b) a first electrode applying step of applying an electrode material to the region of the one flange portion where the external electrode is to be formed by bringing the region of the one flange portion where the external electrode is to be formed and which is projecting from the holding surface, by preforming the step (a), into contact with an electrode material for forming the external electrode;

(c) a rotating step of, after performing the step (b), bringing a rotating jig for rotating the core member into contact with the core member held by the first holding jig, and rotating the core member by moving the rotating jig relative to the first holding jig in a direction along a main surface of the first holding jig such that a region of the other flange portion where the external electrode is to be formed opposedly faces the first holding jig;

(d) a transferring step of, after performing the step (c), transferring the core member held by the first holding jig to a second holding jig which is positioned such that the second holding jig faces the first holding jig and has a holding force for holding the core member, and holding the core member by the second holding jig in a posture where the axis of the winding core portion has a predetermined angle with respect to a holding surface which is a main surface of the second holding jig on a side where the core member is held, and a region of the other flange portion where the external electrode is to be formed projects more from the holding surface of the second holding jig than the one flange portion, and (e) a second electrode applying step of applying an electrode material to the region of the other flange portion where the external electrode is to be formed by bringing the region of the other flange portion where the external electrode is to be formed and which is projecting from the holding surface of the second holding jig, by performing the step (d), into contact with an electrode material for forming the external electrode.

There is provided another (second) method of manufacturing a winding-type coil component which includes: a core member having a columnar winding core portion and a pair of flange portions which is formed on both ends of the winding core portion; a pair of external electrodes formed on one flange portion and the other flange portion of the pair of flange portions; and a winding wound on the winding core portion, wherein the external electrodes are formed on regions of the one flange portion and the other flange portion near an object on which the winding-type coil component is to be mounted such that a height of the external electrodes is gradually increased in an inclined manner from opposedly facing surfaces of the one flange portion and the other flange portion to surfaces of the one flange portion and the other flange portion on a side opposite to the opposedly facing surfaces, wherein a step of forming the external electrodes includes:

(a) a holding step of holding the core member by a first holding jig having a holding force for holding a plurality of the core members in a posture where an axis of the winding core portion has a predetermined angle with respect to a holding surface which is a main surface of the first holding jig on a side where the core member is held, and a region of the one flange portion where the external electrode is to be formed projects more from the holding surface of the first holding jig than the other flange portion, (b) a first electrode applying step of applying an electrode material to the region of the one flange portion where the external electrode is to be formed and which is projecting from the holding surface by bringing the region of the one flange portion where the external electrode is to be formed into contact with an electrode material for forming the external electrode;

(c) a transferring step of, after performing the step (b), transferring the core member held by the first holding jig to a second holding jig which is positioned such that the second holding jig faces the first holding jig and has a holding force for holding the core member, and holding the core member by the second holding jig in a posture where the axis of the winding core portion has a predetermined angle with respect to a holding surface which is a main surface of the second holding jig on a side where the core member is held, and a region of the one flange portion where the electrode material is applied faces the second holding jig, (d) a rotating step of, after performing the step (c), bringing a rotating jig for rotating the core member about an axis of the winding core portion into contact with the core member held by the second holding jig, and rotating the core member by moving the rotating jig relative to the second holding jig in a direction along a main surface of the second holding jig thus bringing the core member into a state where a region of the other flange portion where the external electrode is to be formed projects more from the holding surface of the second holding jig than the one flange portion; and (e) a second electrode applying step of applying an electrode material to the region of the other flange portion where the external electrode is to be formed by bringing the region of the other flange portion where the external electrode is to be formed and which is projecting from the holding surface of the second holding jig, by performing the step (d), into contact with an electrode material for forming the external electrode.

There is also provided still another (third) method of manufacturing a winding-type coil component which includes: a core member having a columnar winding core portion and a pair of flange portions which is formed on both ends of the winding core portion; a pair of external electrodes formed on one flange portion and the other flange portion of the pair of flange portions; and a winding wound on the winding core portion, wherein the external electrodes are formed on regions of the one flange portion and the other flange portion near an object on which the winding-type coil component is to be mounted such that a height of the external electrodes is gradually increased in an inclined manner from opposedly facing surfaces of the one flange portion and the other flange portion to surfaces of the one flange portion and the other flange portion on a side opposite to the opposedly facing surfaces, wherein a step of forming the external electrodes includes:

(a) a holding step of holding the core member by a first holding jig having a holding force for holding a plurality of the core members in a posture where an axis of the winding core portion has a predetermined angle with respect to a holding surface which is a main surface of the first holding jig on a side where the core member is held, and a region of the one flange portion where the external electrode is to be formed projects more from the holding surface of the first holding jig than the other flange portion, (b) a first electrode applying step of applying an electrode material to the region of the one flange portion where the external electrode is to be formed by bringing the region of the one flange portion where the external electrode is to be formed and which is projecting from the holding surface by performing the step (a) into contact with an electrode material for forming the external electrode;

(c) a rotating step of, after performing the step b), pressing the core member held by the first holding jig to a second holding jig which is positioned such that the second holding jig faces the first holding jig and has a holding force for holding the core member, and rotating the core member by moving the second holding jig relative to the first holding jig in a direction along a main surface of the first holding jig such that an axis of the winding core portion has a predetermined angle with respect to the holding surface of the second holding jig, and a region of the other flange portion where the external electrode is to be formed is brought into a state where the region projects more from the holding surface of the second holding jig than the one flange portion;

(d) a transferring and holding step of, after performing the step (c), separating the first holding jig, and bringing a state where an axis of the winding core portion has a predetermined angle with respect to the holding surface of the second holding jig, and a region of the other flange portion where the external electrode is to be formed is brought into a state where the core member is held by the second holding jig in a state where the region projects from the holding surface of the second holding jig; and (e) a second electrode applying step of applying an electrode material to the region of the other flange portion where the external electrode is to be formed by bringing the region of the other flange portion where the external electrode is to be formed and which is projecting from the holding surface of the second holding jig, by performing the step (d), into contact with an electrode material for forming the external electrode.

In the method of manufacturing a winding-type coil component according to the present disclosure, the rotating jig preferably has the structure where a coating layer made of a material which has a friction resistance capable of rotating the core member in the rotating step and elasticity is disposed on a surface of a rigid body material.

With the above-mentioned configuration, it is possible to hold the core member in an intended posture with certainty by rotating the core member. Accordingly, the present disclosure can effectively acquire the intended advantageous effects.

In the method of manufacturing a winding-type coil component according to the present disclosure, it is preferable that, in the rotating step, the core member be rotated 180° about an axis of the winding core portion.

In the method of manufacturing a winding-type coil component according to the present disclosure, it is preferable that, in the rotating step, assuming an axial direction of the winding core portion of the core member as X and a direction perpendicular to the holding surface of one of the first holding jig and the second holding jig on which the core member is held as Y, the core member be configured to be rotatable such that an axis of the winding core portion is rotated on a plane defined by the X and the Y so as to change an angle between the axis of the winding core portion and the holding surface.

In the method of manufacturing a winding-type coil component according to the present disclosure, it is preferable that a holding force of the second holding jig be larger than a holding force of the first holding jig.

With the above-mentioned configuration, it is possible to transfer the core member from the first holding jig to the second holding jig without requiring the complicated configuration. Accordingly, the present disclosure can more effectively acquire the intended advantageous effects.

In the method of manufacturing a winding-type coil component according to the present invention, it is preferable that the first holding jig and the second holding jig hold the core member by an adhesive force.

With the above-mentioned configuration, the method of manufacturing a winding-type coil component according to the present disclosure can be performed with more certainty so that the winding-type coil component can be efficiently manufactured using the first and second holding jigs which can hold the core member with certainty without requiring the complicated configuration.

In the present disclosure, it is desirable that the first and second holding jig hold the core member by an adhesive force. However, depending on cases, it is possible to use jigs which hold the core member by a magnetic force.

In the method of manufacturing a winding-type coil component according to the present disclosure, it is preferable that the holding surfaces of the first holding jig and the second holding jig which hold the core member have an inclined portion or a groove portion with inclined side surfaces such that the core member can be held in a state where the axis of the winding core portion has a predetermined angle with respect to the holding surfaces of the first holding jig and the second holding jig.

With such a configuration, it is possible to hold the core member with certainty in a state where the axis of the winding core portion has a predetermined angle with respect to the holding surfaces of the first and second holding jigs, and to acquire the intended advantageous effects of the present disclosure.

Advantageous Effect of the Disclosure

According to the (first) method of manufacturing a winding-type coil component of the present disclosure, the core member is held on the holding surface of the first holding jig such that the axis of the winding core portion has a predetermined angle with respect to the holding surface of the first holding jig and the region of the one flange portion where the external electrode is to be formed projects from the holding surface. An electrode material is applied to the region of the one flange portion where the external electrode is to be formed. Then, the core member is rotated using the rotating jig. Then, the core member is held by the second holding jig (the core being transferred to the second holding jig). Accordingly, when the core member is held by the second holding jig, it is possible to bring the region of the other flange portion where the external electrode is to be formed into a state where the region projects more from the holding surface of the second holding jig than the one flange portion. That is, although it has been impossible to apply an electrode material to the region of the other flange portion where the external electrode is to be formed so long as the conventional structure is maintained, by rotating the core member using the rotating jig, it is possible to easily make the region of the other flange portion where the external electrode is to be formed project more from the holding surface of the second holding jig than the one flange portion.

By applying an electrode material to the region of the other flange portion where the external electrode is to be formed in such a state, it is possible to form with certainty the external electrode inclined such that a height of the external electrodes is gradually increased in an inclined manner from opposedly facing surfaces of the one flange portion and the other flange portion to surfaces of the one flange portion and the other flange portion on a side opposite to the opposedly facing surfaces (hereinafter referred to as "inclined external electrode") at predetermined positions of the one flange portion and the other flange portion.

Further, according to the (first) method of manufacturing a winding-type coil component of the present disclosure, the core member is rotated by the above-mentioned method and hence, a plurality of core members held on the first holding jig can be rotated together simultaneously. Accordingly, it is possible to treat a large number of core members within a short time. As a result, it is possible to efficiently manufacture highly reliable winding-type coil components having favorable properties and equipped with the external electrodes having high form accuracy.

According to the (second) method of manufacturing a winding-type coil component of the present disclosure, the core member is held on the first holding jig, and an electrode material is applied to the region of the one flange portion where the external electrode is to be formed. Then, the core member is transferred to the second holding jig before being rotated, and the transferred core member is rotated on the second holding jig using the rotating jig. Accordingly, after the rotating step is finished, it is possible to bring the core member into a state where the core member is held on the second holding jig, and the axis of the winding core portion has a predetermined angle with respect to the holding surface of the second holding jig so that the region of the other flange portion where the external electrode is to be formed projects more from the holding surface of the second holding jig than the one flange portion.

Accordingly, by applying an electrode material to the region of the other flange portion where the external electrode is to be formed in such a state, it is possible to form with certainty the inclined external electrode at predetermined positions of the one flange portion and the other flange portion such that a height of the external electrodes is gradually increased in an inclined manner from opposedly facing surfaces of the one flange portion and the other flange portion to surfaces of the one flange portion and the other flange portion on a side opposite to the opposedly facing surfaces.

Further, according to the (second) method of manufacturing a winding-type coil component of the present disclosure, the core member is rotated after the core member is transferred to the second holding jig. Accordingly, at a point in time that the core member is transferred to the second holding jig, the region of the one flange portion where the electrode material is applied is at the position where the region opposedly faces the second holding jig and the rotating jig is not pressed to the region. Accordingly, even when an applied electrode material has a low strength, a damage on the applied electrode material is suppressed and hence, it is possible to manufacture a winding-type coil component having high form accuracy with certainty. Further, usually, a portion of the second holding jig which is brought into contact with the core member is formed of a material which is softer than a portion of the rotating jig which is brought into contact with the core member and is largely deformable. Accordingly, a possibility that the applied electrode material is damaged is reduced also from this viewpoint.

Further, according to the (second) method of manufacturing a winding-type coil component of the present disclosure, the method can acquire substantially the same advantageous effects as the (first) method of manufacturing a winding-type coil component according to the present disclosure also with respect to other points.

According to the (third) method of manufacturing a winding-type coil component of the present disclosure, an electrode material is applied to a region of the one flange portion of the core member held by the first holding jig where the external electrode is to be formed and, then, the core member held by the first holding jig is pressed to the second holding jig which is positioned so as to face the first holding jig, and the core member is rotated by moving the second holding jig relative to the first holding jig in a direction along the main surface of the first holding jig. Accordingly, it is possible to bring the core member into a state where the axis of the winding core portion has a predetermined angle with respect to the holding surface of the second holding jig so that the region of the other flange portion where the external electrode is to be formed projects from the holding surface of the second holding jig.

Accordingly, by applying an electrode material to the region of the other flange portion where the external electrode is to be formed in such a state, it is possible to form with certainty the inclined external electrode at predetermined positions of the one flange portion and the other flange portion such that a height of the external electrodes is gradually increased in an inclined manner from opposedly facing surfaces of the one flange portion and the other flange portion to surfaces of the one flange portion and the other flange portion on a side opposite to the opposedly facing surfaces.

Further, according to the (third) method of manufacturing a winding-type coil component of the present disclosure, the rotating jig becomes unnecessary and hence, it is possible to realize the reduction of a cost of a manufacturing facility and the simplification of a manufacturing process.

Further, according to the (third) method of manufacturing a winding-type coil component of the present disclosure, the method can acquire substantially the same advantageous effects as the (first) method of manufacturing a winding-type coil component according to the present disclosure also with respect to other points.

DETAILED DESCRIPTION

Mode for Carrying Out the Invention

Hereinafter, the technical features of the present disclosure are described in further detail in conjunction with embodiments of the present disclosure.

Embodiment 1

Figure 1A:
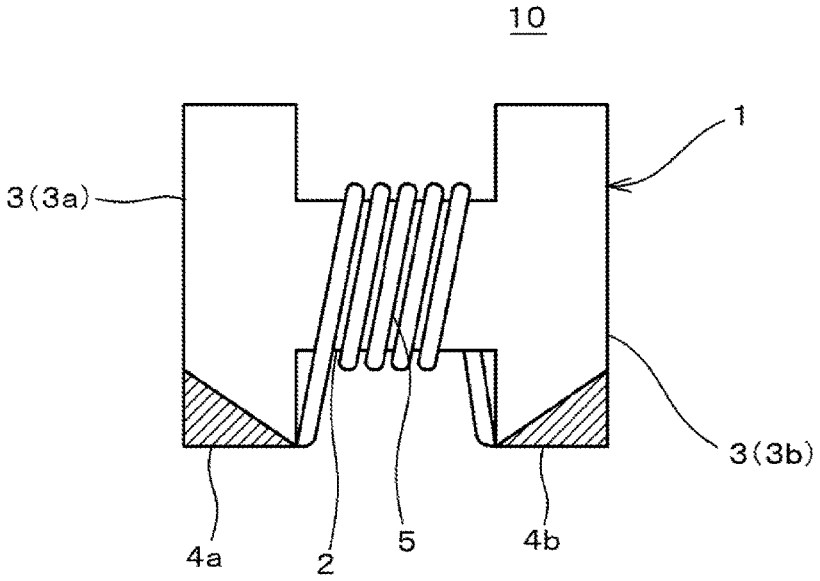
FIG. 1(*a*) and FIG. 1(*b*) are views showing one example of a winding-type coil component manufactured by a method of the present disclosure, wherein FIG. 1(*a*) is a front view, and FIG. 1(*b*) is a side view.
Figure 1B:
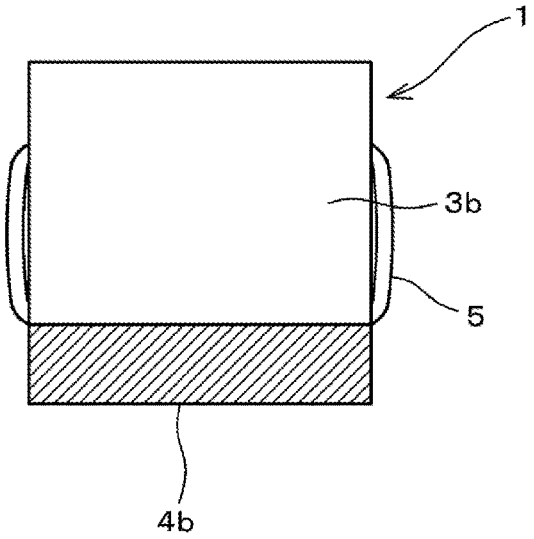

In embodiment 1, a method of manufacturing a winding-type coil component (winding type inductor) having a structure shown in FIG. 1 is described by mainly focusing on steps for forming external electrodes on a core member.

A winding-type coil component 10 manufactured in embodiment 1 includes: a core member 1 having a winding core portion 2 and a pair of flange portions (one flange portion 3*a* and the other flange portion 3*b*) which is connected to both ends of the winding core portion 2; a pair of external electrodes (external electrodes 4*a*, 4*b*) disposed on the one flange portion 3*a* and the other flange portion 3*b* of the core member 1; and a winding 5 wound on the winding core portion 2. Both ends of the winding 5 are connected to the external electrodes 4*a*, 4*b* respectively by soldering or the like.

The external electrodes 4*a*, 4*b* are formed as follows so as to prevent the occurrence of drawbacks such as lowering of a characteristic such as a magnetic field and rounding around of solder to a coil (winding 5). The external electrodes 4*a*, 4*b* are not formed on an opposedly-facing surface (inner wall surface) of the one flange portion 3*a* and an opposedly-facing surface (inner wall surface) of the other flange portion 3*b*, while the external electrodes 4*a*, 4*b* are formed such that the heights of the formed external electrodes 4*a*, 4*b* are increased toward end surface sides (outer wall surfaces) from the opposedly-facing surface sides of the one flange portion 3*a* and the other flange portion 3*b*. That is, the external electrodes 4*a*, 4*b* are formed in a mode where upper sides of the external electrodes on side surfaces of the one flange portion 3*a* and the other flange portion 3*b* are inclined. In this embodiment, a case is exemplified where the electrode is not formed on the inner wall surface of the flange portion. However, the electrode structure is not limited to the above-mentioned structure. The electrodes may also be formed on the inner wall surfaces provided that heights of the formed external electrodes 4*a*, 4*b* formed on the inner wall surfaces are lower than heights of the formed external electrodes 4*a*, 4*b* formed on the outer wall surfaces.

Figure 17:
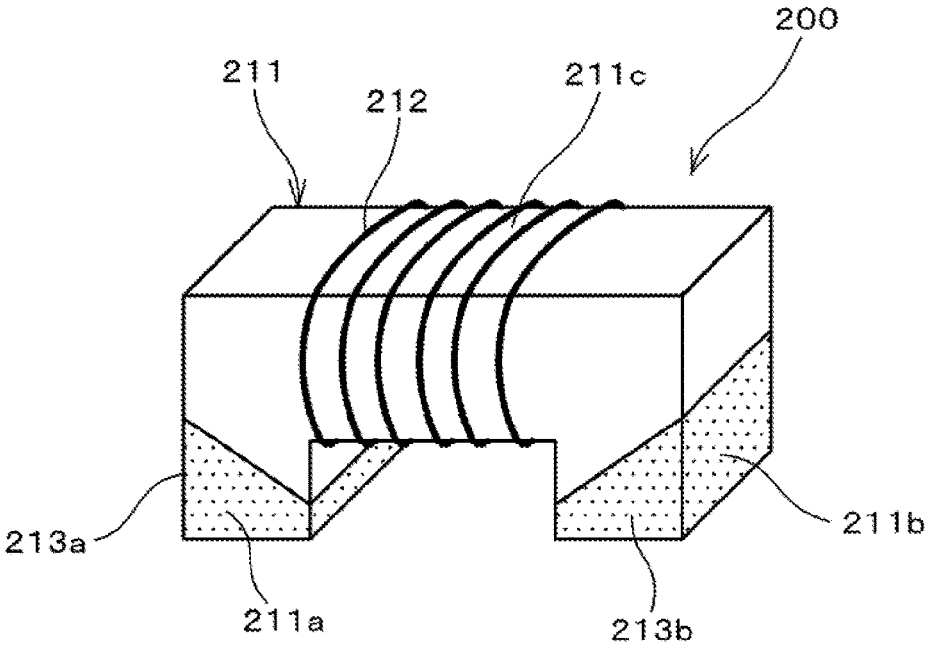
FIG. 17 is a view showing another conventional winding-type coil component.
Figure 18:
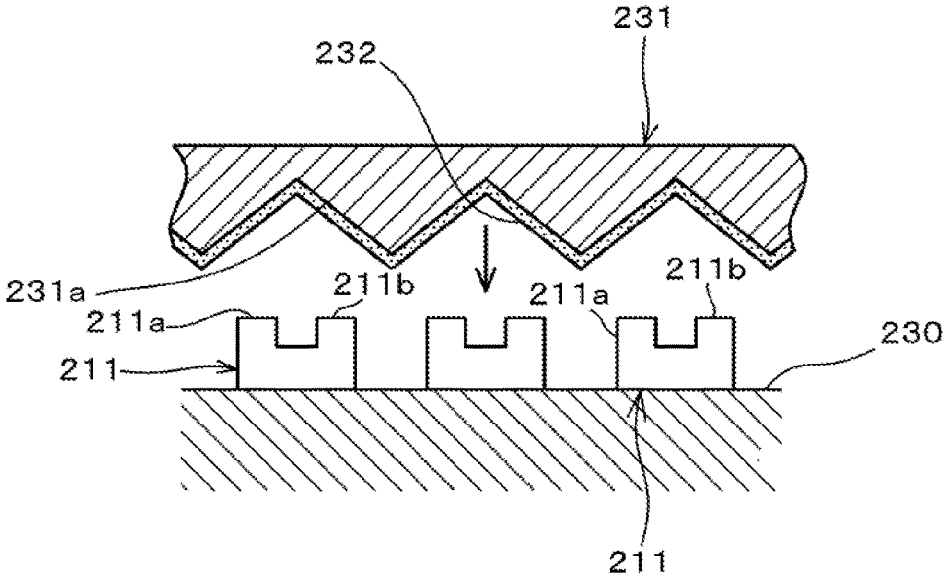
FIG. 18 is a view showing a method of manufacturing a winding-type coil component shown in FIG. 17.

In this embodiment, as the core member 1, a so-called H type core member which includes the flange portions 3 (3*a*, 3*b*) on both end sides of the winding core portion 2 is used. However, a so-called U type core member shown in FIG. 17, an I type core member having no flange portions specifically (not shown in the drawing) or the like may be also used.

Further, as a material for forming the core member 1, a ceramic-based material (alumina, ferrite or the like, for example), a metal magnetic material or the like may be used.

As a material for forming the external electrode 4*a*, 4*b*, silver, copper or the like may be used.

The present disclosure is also applicable to a case of manufacturing a winding-type coil component where the winding 5 is protected by a protection member made of a material which contains a thermosetting resin such as an epoxy resin as a main component.

Next, a method of manufacturing the winding-type coil component 10 is described.

First, a core member 1 shown in FIG. 1 is prepared. The core member 1 includes: the winding core portion 2; and the pair of flange portions (one flange portion 3*a* and the other flange portion 3*b*) which is connected to both ends of the winding core portion 2.

Next, the external electrodes 4*a*, 4*b* are formed in accordance with steps described hereinafter.

Figure 2:
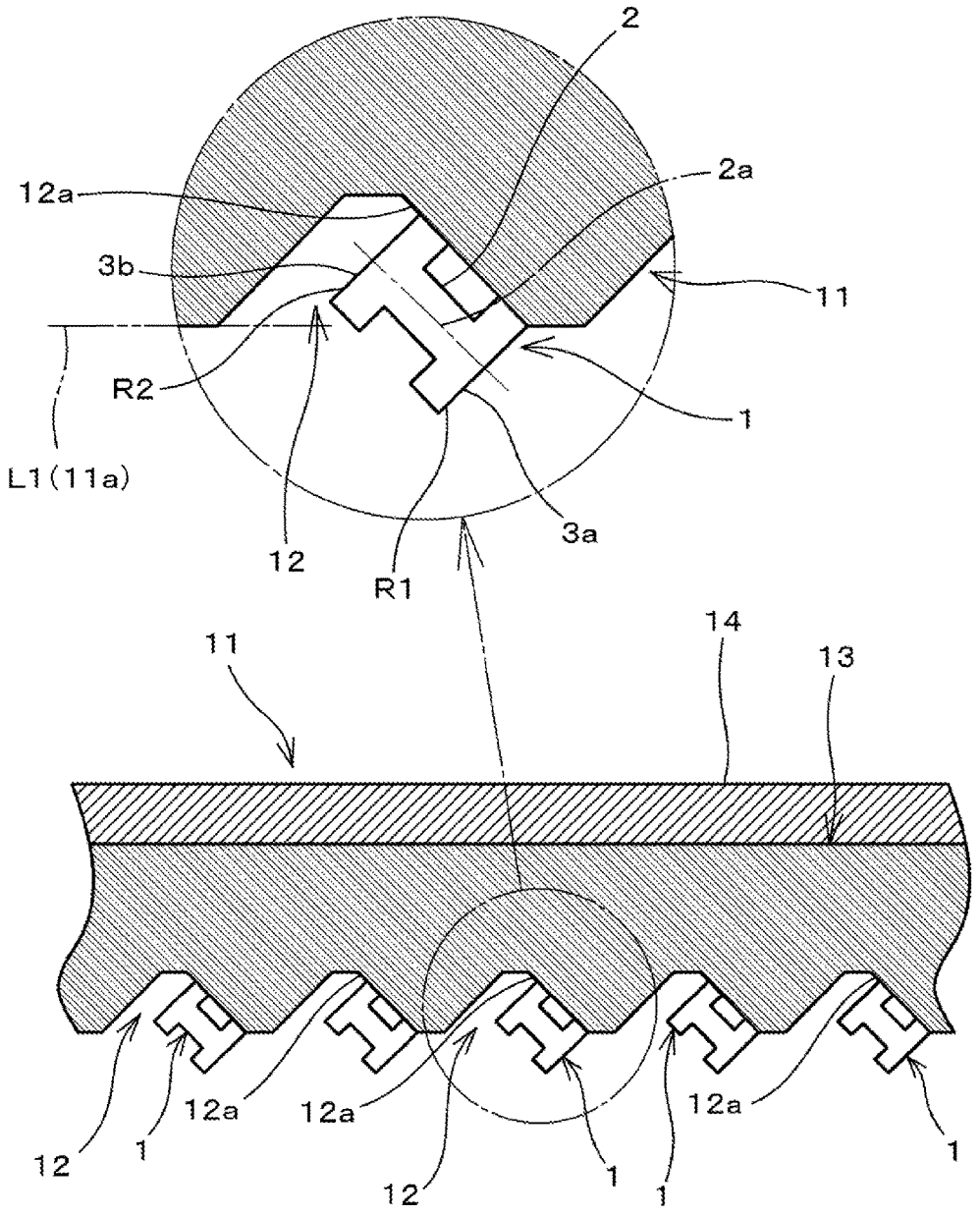
FIG. 2 is a view for describing a method of manufacturing a winding-type coil component according to an embodiment 1 of the present disclosure, and is also a view showing a state where core members are held by a first holding jig.

(a) As shown in FIG. 2, with the use of a first holding jig 11 having a holding force for holding the core member 1 by an adhesive force, the core member 1 is held in a posture where an axis 2*a* of the winding core portion 2 has a predetermined angle with respect to a holding surface (a main surface on a side where the core member 1 is held) 11*a* of the first holding jig 11, and a region R1 of the one flange portion 3*a* where the external electrode is to be formed projects more downward from the holding surface 11*a* of the first holding jig 11 than the other flange portion 3*b* (holding step).

The holding surface (main surface) 11*a* of the first holding jig 11 shown in FIG. 2 is a surface along which a line L1 connecting points on both end sides of each groove 12 having large heights is positioned.

In embodiment 1, as the first holding jig 11, a holding jig is used where groove portions 12 each having an inclined side surface 12*a* are formed on the main surface (holding surface) 11*a*. With such a configuration, the first holding jig 11 can hold the core member 1 in a state where the axis 2*a* of the winding core portion 2 has a predetermined angle with respect to the holding surface 11*a* of the first holding jig 11. An upper surface of the one flange portion 3*a* and an upper surface of the other flange portion 3*b* are detachably fixed onto the one-side surface 12*a* of the groove portion 12. It is preferable that a predetermined gap be formed between the other side surface of the groove portion 12 which opposedly faces the one-side surface 12*a* and an outer wall surface of the other flange portion 3*b* so as to allow the core member 1 to be rotated in a rotating step described later.

The first holding jig 11 is formed by bonding an adhesive silicone rubber holding member 13 which has the above-mentioned groove portions 12 to a metal plate 14. Other materials such as fluororubber may be used as a material for forming the holding member 13.

The first holding jig 11 is configured to hold the core members 1 in a state where the core members 1 are arranged on a surface of the first holding jig 11 in a two-dimensional matrix array.

Figure 3:
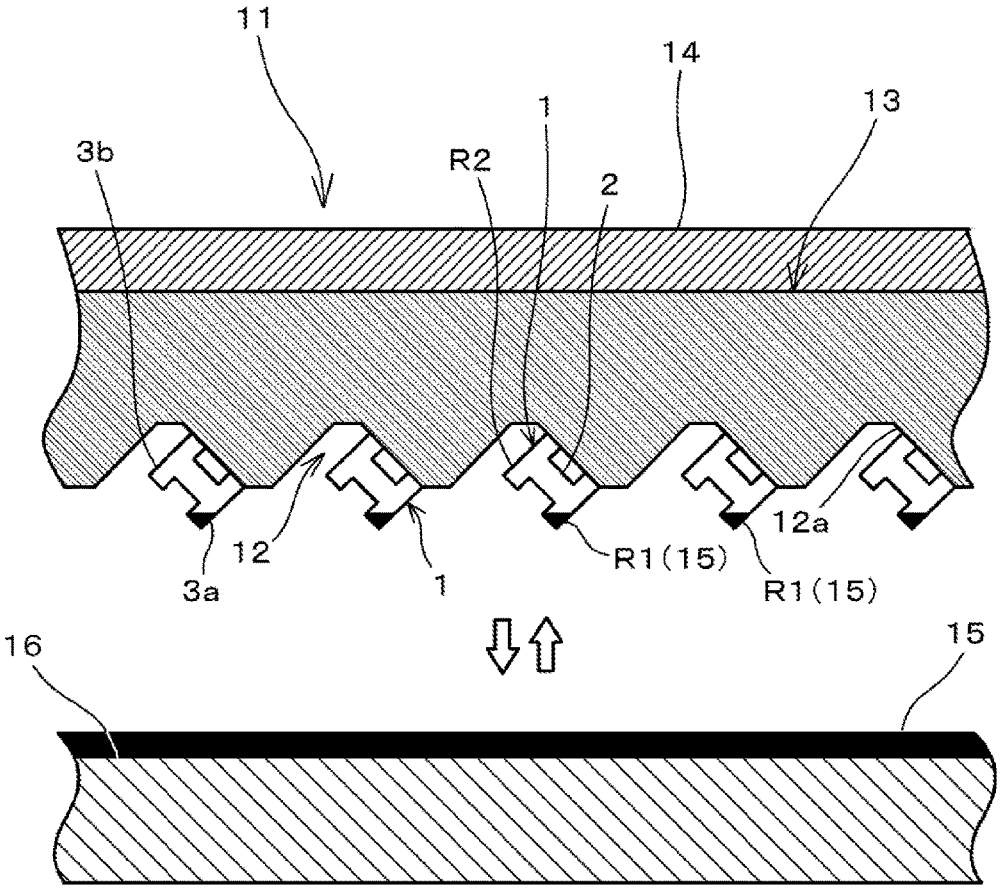
FIG. 3 is a view showing a state where an electrode material is applied to each region of one flange portions of the core members where an external electrode is to be formed in a step of manufacturing a winding-type coil component according to embodiment 1 of the present disclosure.

(b) By performing the above-mentioned step (a) so that the core member 1 is held by the first holding jig 11, and by bringing the region R1 of the one flange portion 3*a* of the core member 1 where an external electrode is to be formed and which is projecting downward from the holding surface 11*a* into contact with a conductive paste (an electrode material for forming the external electrode) 15 held on a table 16, as shown in FIG. 3, the conductive paste 15 is applied (by coating) to the region R1 of the one flange portion 3*a* where the external electrode is to be formed (first electrode applying step). Then, the applied conductive paste 15 is dried.

As a conductive material for forming a conductive paste, various materials can be used for forming external electrodes which can be bonded to an object such as an electrode of a printed circuit board where a winding-type coil component is mounted by soldering or the like. More specifically, for example, a silver paste, a copper paste or the like can be used. Further, as an electrode material, a resin which contains metal powder or the like can be also used. A conductive paste is formed with a uniform thickness on a table installed horizontally by moving a squeegee while maintaining a predetermined distance between the table and the squeegee.

Figure 4A:
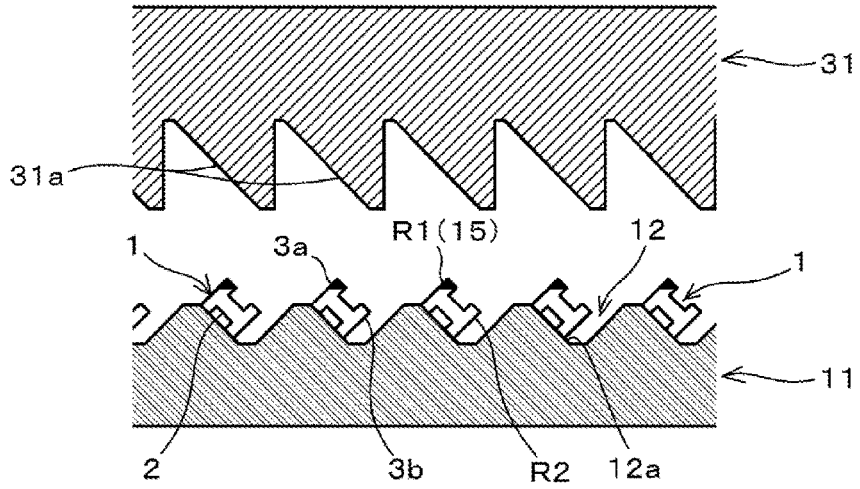
FIG. 4(*a*) to FIG. 4(*c*) are views for describing a method of rotating each core member held by the first holding jig about an axis of a winding core portion in one step of the method of manufacturing a winding-type coil component according to embodiment 1 of the present disclosure.
Figure 4B:
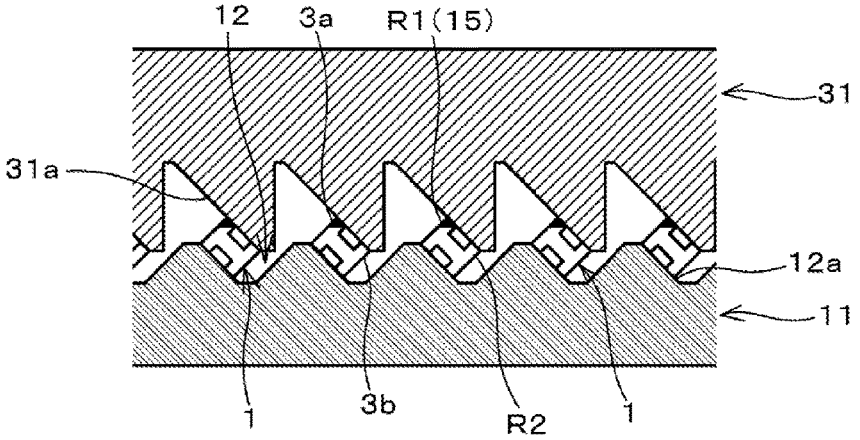
Figure 4C:
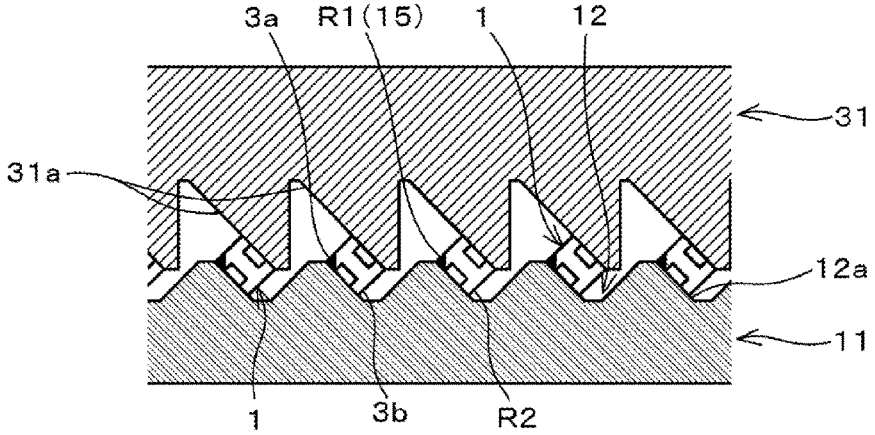

(c) Next, as shown in FIG. 4(*a*), the first holding jig 11 is inverted upside down thus bringing the core member 1 into a state where the axis 2*a* of the winding core portion 2 of the core member 1 has a predetermined angle with respect to the holding surface (the main surface on a side where the core member 1 is held) 11*a* of the first holding jig 11, and the region of the one flange portion 3*a* of the core member 1 to which the conductive paste 15 is applied (the region where the external electrode is to be formed) R1 projects upward more from the holding surface (main surface) 11*a* of the first holding jig 11 than the other flange portion 3*b*.

Then, a rotating jig 31 for rotating the core member 1 about the axis 2*a* of the winding core portion 2 is positioned such that the rotating jig 31 faces the holding surface (main surface) 11*a* of the first holding jig 11 which holds the core member 1 (see FIG. 4(*a*)).

Although not particularly shown in the drawing, the rotating jig 31 has the structure which includes a coating layer made of a material having both a friction resistance and elasticity on a surface of a metal base. However, to prevent the core member 1 from being transferred (adhered) to a rotating jig 31 side from the first holding jig 11, a material (for example, a rubber-based material) which forms the coating layer may be a material having a lower adhesive force than the first holding jig 11.

Figures 5A, 5B, 5C, 5D, 5E:
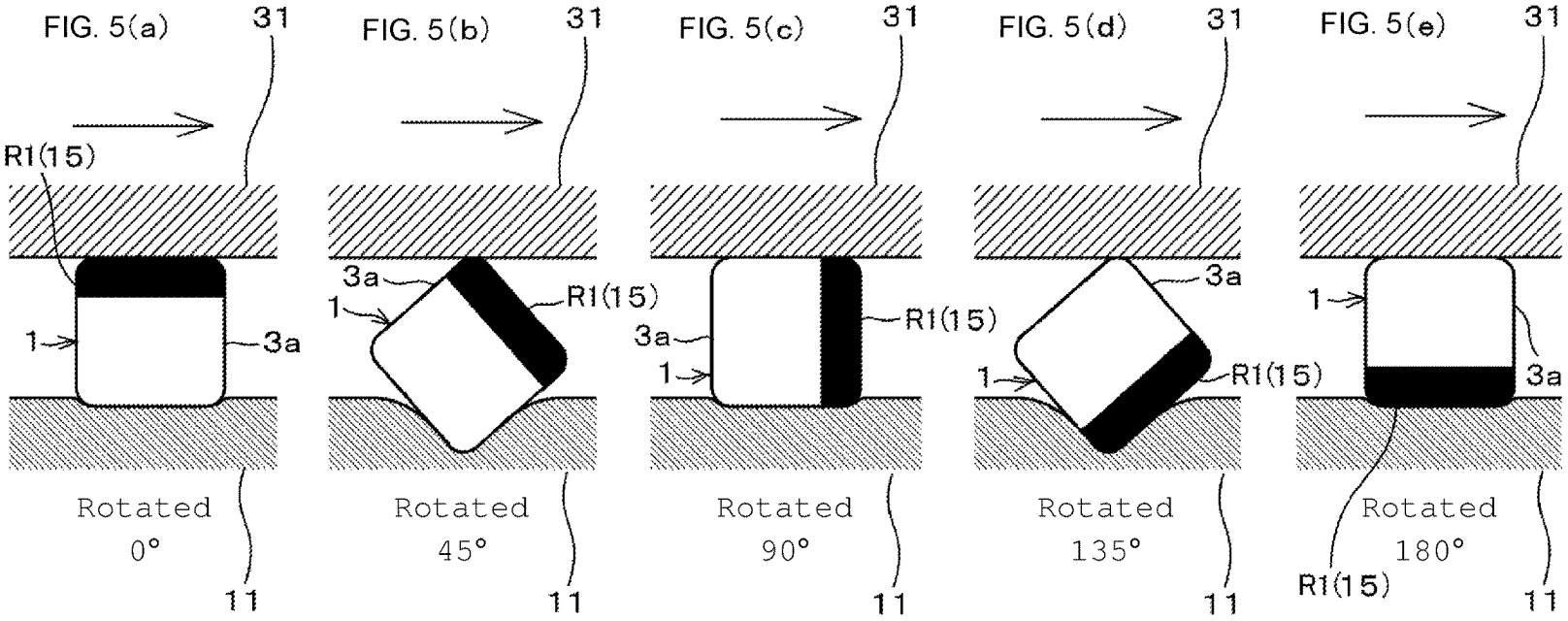
FIG. 5(*a*) to FIG. 5(*e*) are views showing steps of rotating the core member about the axis of the winding core portion in one step of the method of manufacturing a winding-type coil component according to embodiment 1 of the present disclosure.

Then, as shown in FIG. 4(*b*), an inclined portion 31*a* of the rotating jig 31 is brought into contact with the core member 1. Next, the rotating jig 31 is moved relative to the first holding jig 11 in a depth direction of a surface of a paper on which FIG. 4(*b*) is described (direction along the main surface 11*a* of the first holding jig and the direction along the longitudinal direction of the groove portion 12), and the core member 1 is rotated 180° about the axis 2*a* of the winding core portion 2 as shown in FIGS. 5(*a*), 5(*b*), 5(*c*), 5(*d*), and 5(*e*). With such operations, as shown in FIG. 4(*c*), the core member 1 is brought into a posture where the region of the one flange portion 3*a* where the external electrode is to be formed (the region to which the conductive paste 15 is applied) R1 opposedly faces the first holding jig 11, the region R2 of the other flange portion 3*b* where the external electrode is to be formed also faces the first holding jig 11, and the region R2 of the other flange portion 3*b* where the external electrode is to be formed is positioned below the region of the one flange portion 3*a* where the external electrode is to be formed (the region to which the conductive paste 15 is applied) R1 (rotating step).

FIGS. 5(*a*), 5(*b*), 5(*c*), 5(*d*), and FIG. 5(*e*) each sequentially show a state obtained by rotating the core member 1 about the axis 2*a* of the winding core portion 2 from 0° to 180° at intervals of 45°.

Figure 6A:
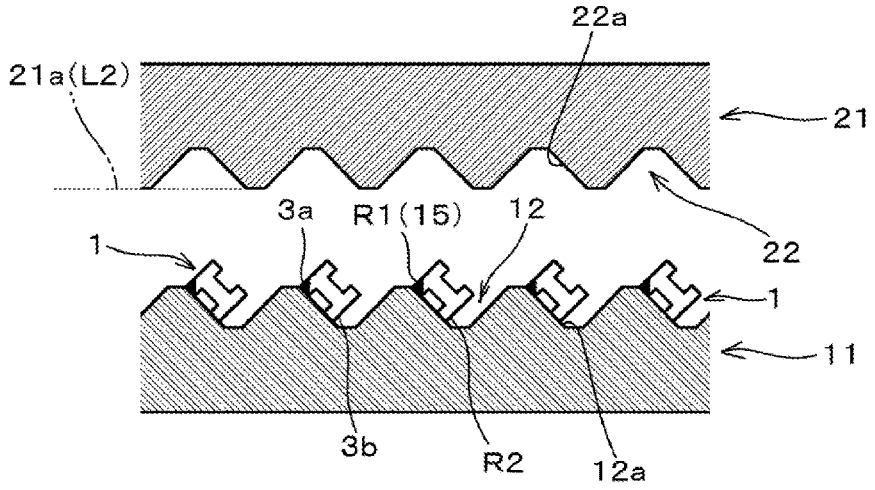
FIG. 6(*a*) to FIG. 6(*c*) are views for describing a method of transferring the core members after the rotation to a second holding jig in one step of the method of manufacturing a winding-type coil component according to embodiment 1 of the present disclosure.
Figure 6B:
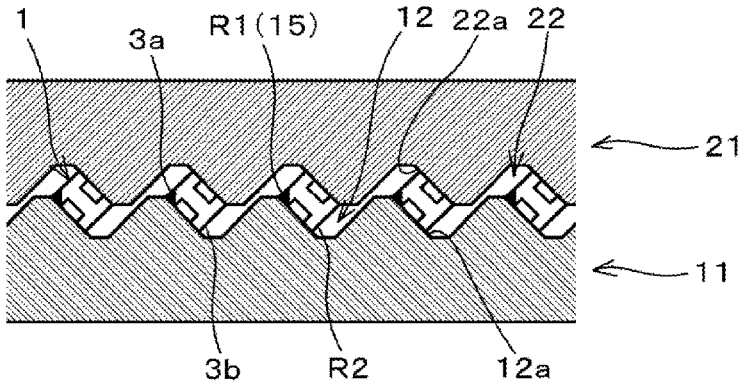
Figure 6C:
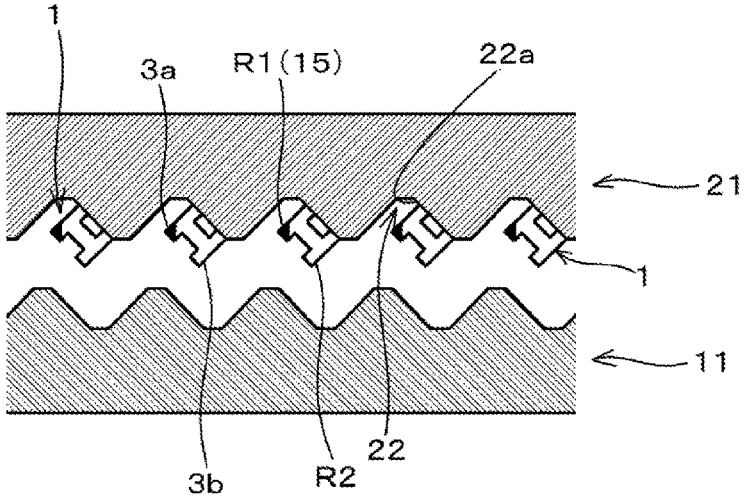

(d) Next, the rotating jig 31 is removed. Then, as shown in FIG. 6(*a*), a second holding jig 21 having a holding force for holding the core member 1 is positioned so as to face the first holding jig 11 which holds the core member 1. Then, as shown in FIG. 6(*b*), the second holding jig 21 is pressed to the core member 1 held by the first holding jig 11 and, thereafter, as shown in FIG. 6(*c*), the core member 1 is transferred to the second holding jig 21 by separating the first holding jig 11 from the core member 1 (transferring step).

With such operations, the core member 1 is held by the second holding jig 21 in a posture where the axis 2*a* of the winding core portion 2 of the core member 1 has a predetermined angle with respect to a holding surface of the second holding jig (a surface in a horizontal direction shown in FIG. 6(*c*) and forming a main surface on a side where the core member 1 is held) 21*a*, and the region R2 of the one flange portion 3*b* where the external electrode is to be formed projects more downward from the holding surface 21*a* of the second holding jig 21 than the one flange portion 3*a*.

The second holding jig 21, in the same manner as the above-mentioned first holding jig 11, is formed by bonding an adhesive silicone rubber holding member 23 to a metal plate 24. To enable the second holding jig 21 to hold the core member 1 in a state where the axis 2*a* of the winding core portion 2 has a predetermined angle with respect to the holding surface (the main surface which is a surface in a horizontal direction) 21*a*, groove portions 22 each having inclined side surfaces 22*a* are formed on the main surface (holding surface) 21*a*.

The holding surface (main surface) 21*a* of the second holding jig 21 is a surface along which a line L2 connecting points on both end sides of each groove 22 having large heights is positioned.

As the holding member 23 which forms a part of the second holding jig 21, a member having a higher holding force for holding the core member 1 than the holding member 13 which forms a part of the first holding jig 11 is used. Accordingly, the core member 1 held by the first holding jig 11 is transferred to the second holding jig 21 with certainty in the step as shown in FIG. 6(*c*).

Figure 7:
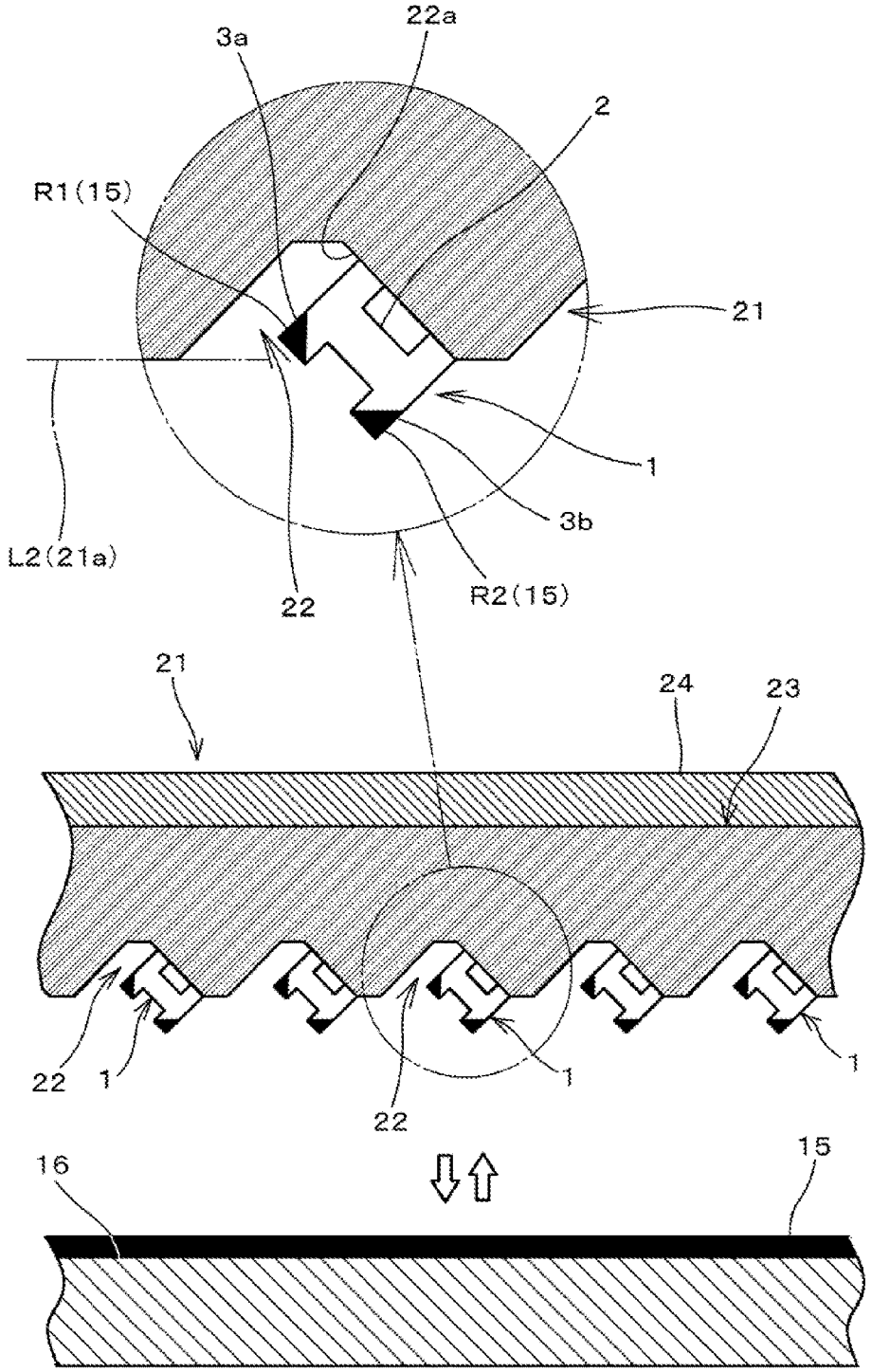
FIG. 7 is a view showing a state where the electrode material is applied to each region of other-side flange portions of the core members where an external electrode is to be formed in one step of the method of manufacturing a winding-type coil component according to embodiment 1 of the present disclosure.

(e) Next, as shown in FIG. 7, the downwardly projected region R2 of the other flange portion 3*b* where the external electrode is to be formed is brought into contact with a conductive paste (an electrode material for forming the external electrode) 15 held on the table 16 so that the electrode material (conductive paste) 15 is applied (by coating and drying) to the region R2 of the other flange portion 3*b* where the external electrode is to be formed (second electrode applying step).

Then, after applying the conductive paste to the region R1 of the one flange portion 3*a* where the external electrode is to be formed and the region R2 of the other flange portion 3*b* where the external electrode is to be formed, the core member is fired so that the conductive paste is glazed whereby it is possible to acquire the core member 1 provided with a pair of external electrodes 4*a*, 4*b* having a predetermined shape on the one flange portion 3*a* and the other flange portion 3*b*.

Then, by winding the winding 5 on the winding core portion 2 of the core member 1 and connecting both ends of the winding 5 to the external electrodes 4*a*, 4*b* by soldering or the like, it is possible to acquire the winding-type coil component 10 having the structure shown in FIG. 1.

As described above, according to the method of manufacturing a winding-type coil component of embodiment 1, it is possible to form with certainty the core member provided with the external electrodes (inclined external electrodes) inclined such that a height of the external electrodes is gradually increased in an inclined manner from opposedly facing surfaces of the one flange portion and the other flange portion to surfaces of the one flange portion and the other flange portion on a side opposite to the opposedly facing surfaces at predetermined positions of the one flange portion and the other flange portion.

The core member is rotated about the axis of the winding core portion by the above-mentioned method and hence, a plurality of core members held on the first holding jig can be rotated together simultaneously. Accordingly, it is possible to treat a large number of core members within a short time. As a result, it is possible to efficiently manufacture highly reliable winding-type coil components having favorable properties and equipped with the external electrodes having high form accuracy.

Embodiment 2

Next, another method of manufacturing a winding-type coil component 10 is described.

In the same manner as the embodiment, a core member 1 (see FIG. 1) is prepared. The core member 1 includes: a winding core portion 2; and a pair of flange portions (one flange portion 3*a* and the other flange portion 3*b*) which is connected to both ends of the winding core portion 2.

External electrodes 4*a*, 4*b* are formed in accordance with steps described hereinafter.

(a) In the same manner as the above-mentioned embodiment 1, as shown in FIG. 2, with the use of a first holding jig 11 having a holding force for holding the core member 1 by an adhesive force, the core member 1 is held in a posture where an axis 2*a* of the winding core portion 2 has a predetermined angle with respect to a holding surface (a main surface on a side where the core member 1 is held) 11*a* of the first holding jig 11, and a region R1 of the one flange portion 3*a* where the external electrode is to be formed projects more downward from the holding surface 11*a* of the first holding jig 11 than the other flange portion 3*b* (holding step).

Also in embodiment 2, as the first holding jig 11, a holding jig equal to the first holding jig 11 used in embodiment 1 is used.

(b) By performing the above-mentioned step (a) so that the core member 1 is held by the first holding jig 11, and, in the same manner as the above-mentioned embodiment 1, as shown in FIG. 3, by bringing the region R1 (see FIG. 2) of the one flange portion 3*a* of the core member 1 where an external electrode is to be formed and which is projecting downward from the holding surface 11*a* into contact with a conductive paste (an electrode material for forming the external electrode) 15 held on the table 16, the conductive paste 15 is applied (by coating and drying) to the region R1 of the one flange portion 3*a* where the external electrode is to be formed (first electrode applying step).

Figure 8A:
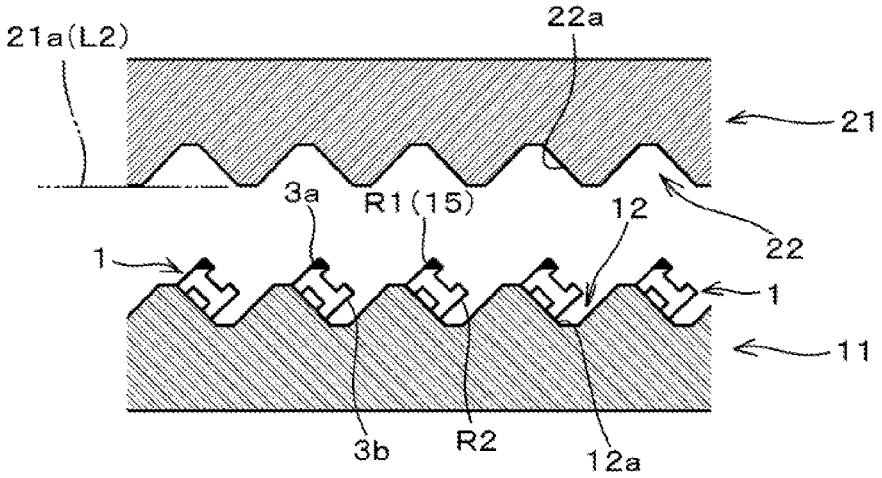
FIG. 8(*a*) to FIG. 8(*c*) are views for describing a method of transferring core members after an electrode material is applied to each region of one flange portions where the external electrode is to be formed to a second holding jig in one step of a method of manufacturing a winding-type coil component according to an embodiment 2 of the present disclosure.
Figure 8:
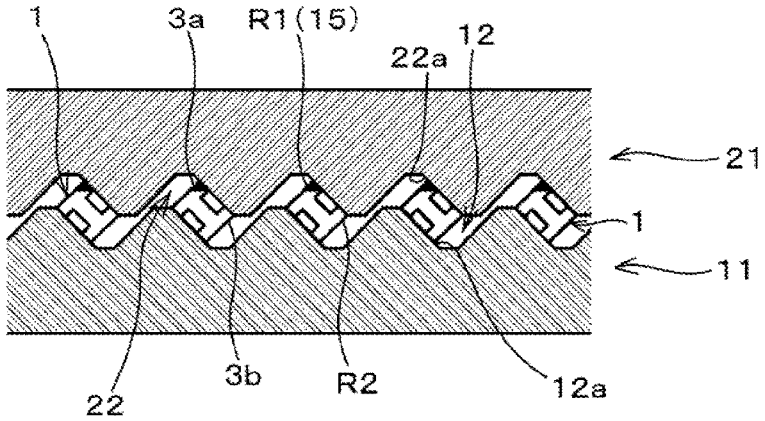
Figure 8C:
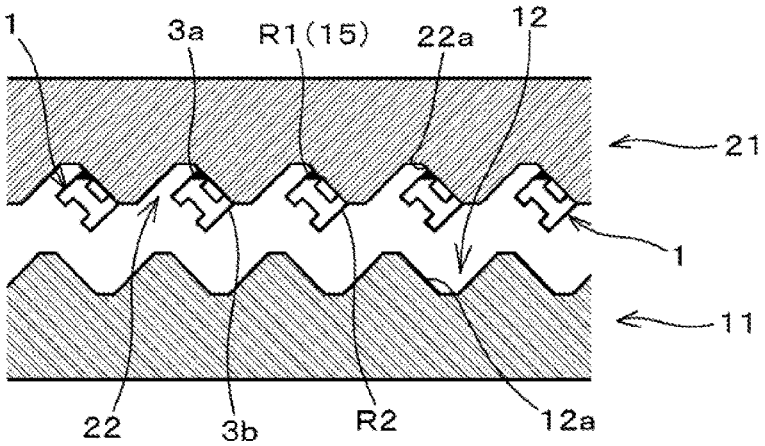

(c) Next, as shown in FIG. 8(*a*), the first holding jig 11 is inverted upside down thus bringing the core member 1 into a state where the axis 2*a* of the winding core portion 2 of the core member 1 has a predetermined angle with respect to the holding surface (the main surface on a side where the core member 1 is held) 11*a* of the first holding jig 11, and the region of the one flange portion 3*a* of the core member 1 to which the conductive paste 15 is applied (the region where the external electrode is to be formed) R1 projects upward more from the holding surface (main surface) 11*a* of the first holding jig 11 than the other flange portion 3*b*.

Next, a second holding jig 21 having a holding force for holding the core member 1 is positioned so as to face the inverted first holding jig 11 (FIG. 8(*a*)). Then, as shown in FIG. 8(*b*), the second holding jig 21 is pressed to the core member 1 held by the first holding jig 11 and, thereafter, as shown in FIG. 8(*c*), the core member 1 is transferred to the second holding jig 21 by separating the first holding jig 11 and the second holding jig 21 from each other (transferring step).

Also in embodiment 2, as the second holding jig 21, a holding jig equal to the second holding jig 21 used in embodiment 1 is used.

Figure 9A:
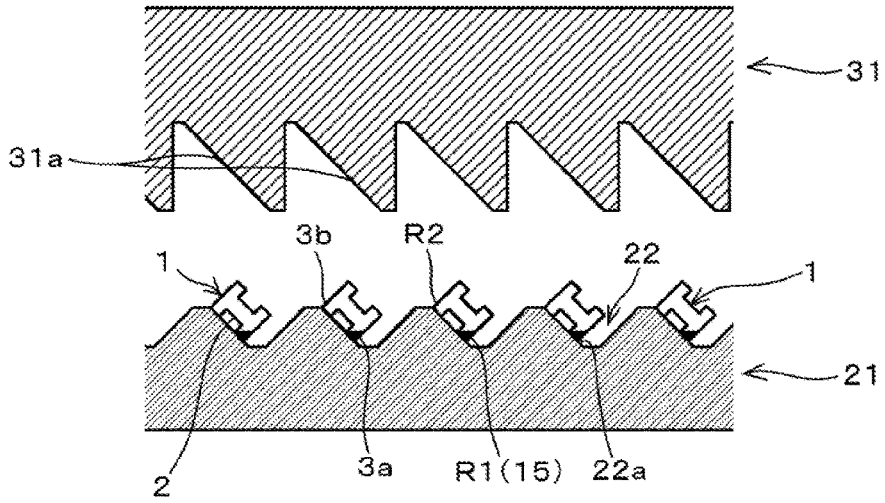
FIG. 9(*a*) to FIG. 9(*c*) are views for describing a method of rotating each core member held by the second holding jig about an axis of a winding core portion in one step of the method of manufacturing the winding-type coil component according to embodiment 2 of the present disclosure.
Figure 9B:
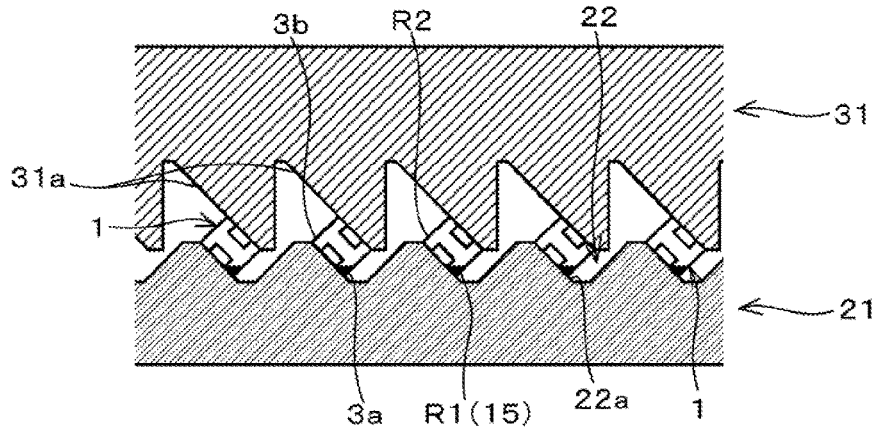
Figure 9C:
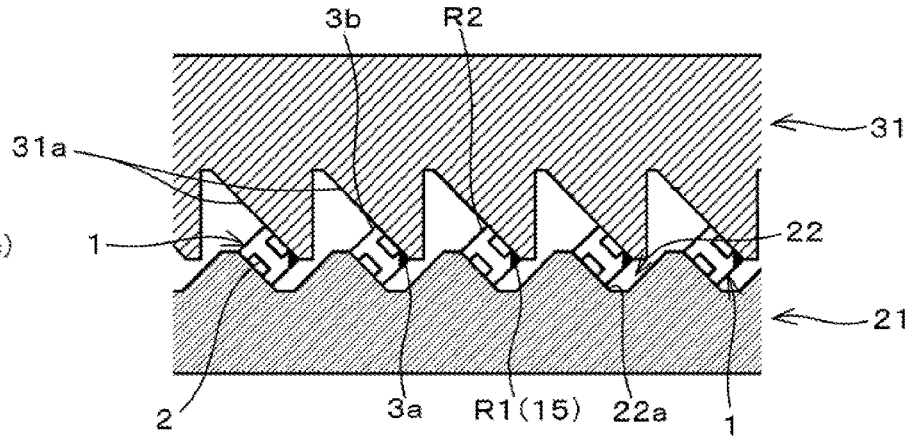

(d) Then, the second holding jig 21 which holds the core member 1 is inverted and, thereafter, as shown in FIG. 9(*a*), a rotating jig 31 for rotating the core member 1 about the axis 2*a* of the winding core portion 2 is positioned such that the rotating jig 31 faces the holding surface (main surface) 21*a* of the second holding jig 21. Then, as shown in FIG. 9(*b*), an inclined portion 31*a* of the rotating jig 31 is brought into contact with the core member 1, and the rotating jig 31 or the second holding jig 21 is moved relatively in a direction along a depth direction of a surface of a paper on which FIG. 9(*b*) is described (a direction along a main surface (holding surface) of the second holding jig 21*a*) and in a direction along a longitudinal direction of the groove portion 22 so that the core member 1 is rotated 180° about the axis 2*a* of the winding core portion 2 (rotating step).

With such operations, as shown in FIG. 9(*c*), the core member 1 held by the second holding jig 21 is brought into a posture where the axis 2*a* of the winding core portion 2 has a predetermined angle with respect to the holding surface 21*a* of the second holding jig 21, and the region R2 of the other flange portion 3*b* where the external electrode is to be formed is positioned on a side opposite to a side where the region R2 opposedly faces the second holding jig 21.

As the rotating jig 31, a rotating jig having the same configuration as the rotating jig used in embodiment 1 is used. However, to prevent the core member from being transferred (adhered) to a rotating jig 31 side from the second holding jig 21, a material (for example, a rubber-based material) which forms the coating layer may be a material having a lower adhesive force than the second holding jig 21.

(e) Next, the rotating jig 31 is removed, and in the same manner as the above-mentioned embodiment 1, as shown in FIG. 7, the second holding jig 21 is inverted, and the region R2 of the other flange portion 3*b* where the external electrode is to be formed and projects downward from the holding surface 21*a* of the second holding jig 21 is brought into contact with a conductive paste (an electrode material for forming the external electrode) held on the table 16 so that the electrode material (conductive paste) 15 is applied (by coating and drying) to the region R2 of the other flange portion 3*b* where the external electrode is to be formed (second electrode applying step).

Then, after applying the conductive paste to the region R1 of the one flange portion 3*a* where the external electrode is to be formed and the region R2 of the other flange portion 3*b* where the external electrode is to be formed as described above, the core member is fired so that the conductive paste is glazed whereby it is possible to acquire the core member 1 provided with a pair of external electrodes 4*a*, 4*b* having a predetermined shape on the one flange portion 3*a* and the other flange portion 3*b*.

Then, by winding the winding 5 on the winding core portion 2 of the core member 1 and connecting both ends of the winding 5 to the external electrodes 4*a*, 4*b* by soldering or the like, it is possible to acquire the winding-type coil component 10 having the structure shown in FIG. 1.

Also according to the method of manufacturing a winding-type coil component of embodiment 2, it is possible to form with certainty the core member provided with the external electrodes (inclined external electrodes) inclined such that a height of the external electrodes is gradually increased in an inclined manner from opposedly facing surfaces of the one flange portion and the other flange portion to surfaces of the one flange portion and the other flange portion on a side opposite to the opposedly facing surfaces at predetermined positions of the one flange portion and the other flange portion.

The core member is rotated about the axis of the winding core portion by the above-mentioned method and hence, a plurality of core members held on the first holding jig can be rotated together simultaneously. Accordingly, it is possible to treat a large number of core members within a short time. As a result, it is possible to efficiently manufacture highly reliable winding-type coil components having favorable properties and equipped with the external electrodes having high form accuracy.

Further, according to embodiment 2, the core member is rotated after the core member is transferred to the second holding jig. Accordingly, at a point of time that the core member is transferred to the second holding jig, the region of the one flange portion where the electrode material is applied is at the position where the region opposedly faces the second holding jig (that is, at the position where the rotating jig is not pressed to the region). Accordingly, even when an applied electrode material has a low strength, damage on the applied electrode material is suppressed and hence, it is possible to form an external electrode having high form accuracy. Further, usually, a portion of the second holding jig which is brought into contact with the core member is formed of a material which is softer than a portion of the rotating jig which is brought into contact with the core member and is largely deformable. Accordingly, a possibility that the applied electrode material is damaged is also reduced from this viewpoint.

Further, at the time of rotating the core member about the axis of the winding core portion by bringing the rotating jig into contact with the core member held on the second holding jig, the rotating jig is brought into contact with the regions of the one flange portion and the other flange portion where a conductive paste for forming the external electrode is not formed and hence, it is possible to suppress damage on the applied conductive paste.

According to the method of manufacturing a winding-type coil component of embodiment 2, the method can acquire substantially the same advantageous effects as the method of manufacturing a winding-type coil component of the above-mentioned embodiment 1 also with respect to other points.

Embodiment 3

Next, still another method of manufacturing a winding-type coil component 10 is described.

In the same manner as embodiment 1, a core member 1 (see FIG. 1) is prepared. The core member 1 includes: a winding core portion 2; and a pair of flange portions (one flange portion 3*a* and the other flange portion 3*b*) which is connected to both ends of the winding core portion 2.

External electrodes 4*a*, 4*b* are formed in accordance with steps described hereinafter.

(a) In the same manner as the above-mentioned embodiment 1, as shown in FIG. 2, with the use of a first holding jig 11 having a holding force for holding the core member 1 by an adhesive force, the core member 1 is held in a posture where an axis 2*a* of the winding core portion 2 has a predetermined angle with respect to a holding surface (a main surface on a side where the core member 1 is held) 11*a* of the first holding jig 11, and a region R1 of the one flange portion 3*a* where the external electrode is to be formed projects more downward from the holding surface 11*a* of the first holding jig 11 than the other flange portion 3*b* (holding step).

Also in embodiment 3, as the first holding jig 11, a holding jig equal to the first holding jig 11 used in embodiment 1 is used.

(b) By performing the above-mentioned step (a) so that the core member 1 is held by the first holding jig 11, and, in the same manner as the above-mentioned embodiment 1, as shown in FIG. 3, by bringing the region R1 (see FIG. 2) of the one flange portion 3*a* of the core member 1 where an external electrode is to be formed and which is projecting downward from the holding surface 11*a* into contact with a conductive paste (an electrode material for forming the external electrode) 15 held on the table 16, the conductive paste 15 is applied (by coating and drying) to the region R1 of the one flange portion 3*a* where the external electrode is to be formed (first electrode applying step).

Figure 10A:
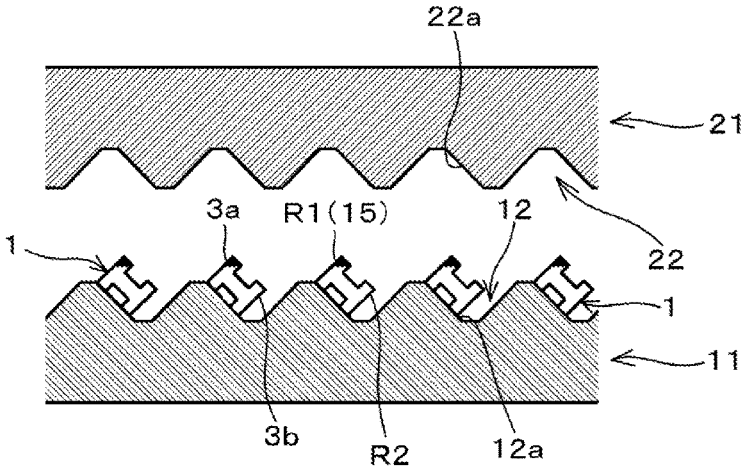
FIG. 10A(a) is a view showing a state where a second holding jig is positioned so as to face a first holding jig after the first holding jig is inverted in one step of a method of manufacturing a winding-type coil component according to an embodiment 3 of the present disclosure, and FIG. 10A(b) is a view showing a state where the second holding jig is brought into contact with the core members held by the first holding jig.
Figure 10A:
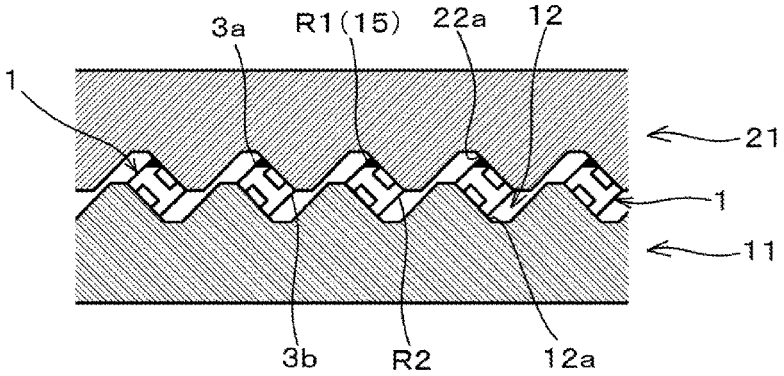

(c) Next, as shown in FIG. 10A(a), the first holding jig 11 is inverted upside down thus bringing the core member 1 into a state where the region of the one flange portion 3*a* of the core member 1 to which the conductive paste 15 is applied (the region where the external electrode is to be formed) R1 projects upward from the holding surface (main surface) 11*a* of the first holding jig 11.

Next, a second holding jig 21 having a holding force for holding the core member 1 is positioned so as to face the inverted first holding jig 11 (FIG. 10A(a)). Then, as shown in FIG. 10A(b), the second holding jig 21 is brought into contact with the core member 1 held by the first holding jig 11.

Also in embodiment 3, as the second holding jig 21, a holding jig equal to the second holding jig 21 used in embodiment 1 is used.

Figure 10B:
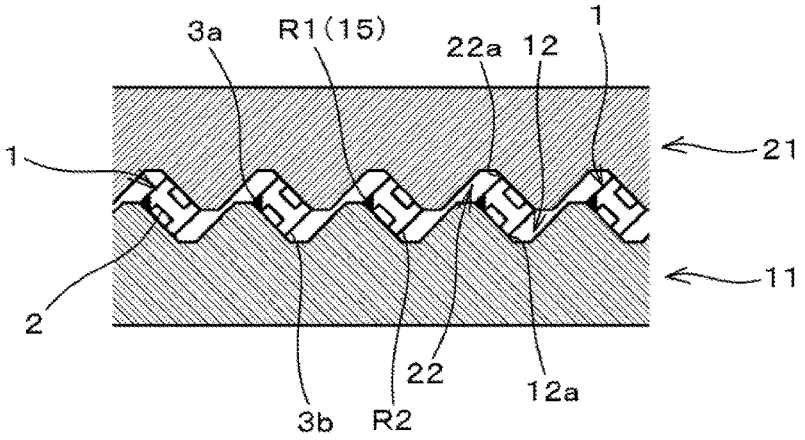
FIG. 10B(a) is a view for describing a method of rotating each core member about an axis of the winding core portion in a state shown in FIG. 10A(b), and FIG. 10B(b) is a view showing a state where the core members after the rotation are transferred to the second holding jig.
Figure 10B:
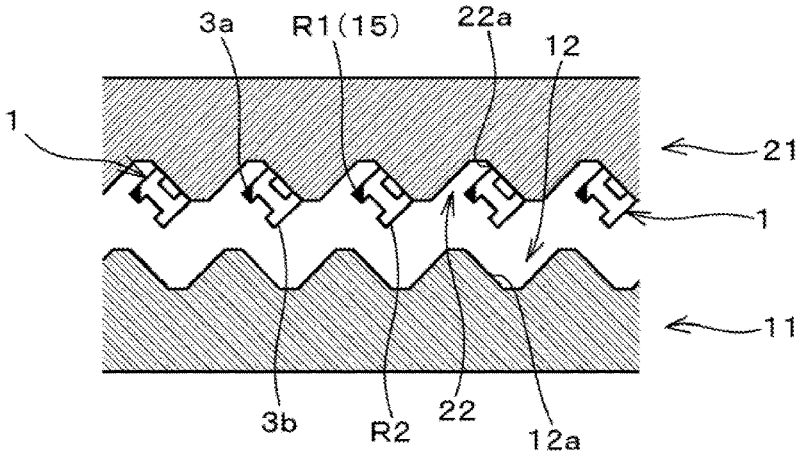

Then, the first holding jig 11 or the second holding jig 21 is moved relatively in a direction along a depth direction of a surface of a paper on which FIG. 10B(b) is described (a direction along main surfaces 11*a*, 21*a* of the first and second holding jig 11, 12 and also a direction along longitudinal directions of the groove portions 12, 22) so that the core member 1 is rotated 180° about the axis 2*a* of the winding core portion 2 (rotating step). In this case, the core member 1 is brought into a posture where the axis 2*a* of the winding core portion 2 has a predetermined angle with respect to the holding surface (main surface) 21*a* of the second holding jig 21, and the region R2 of the other flange portion 3*b* where the external electrode is to be formed is positioned on a side opposite to a side where the region R2 opposedly faces the second holding jig 21.

(d) Then, as shown in FIG. 10B(b), the first holding jig 11 and the second holding jig 21 are separated from each other, and the core member 1 is held by the second holding jig 21. With such operations, the core member 1 is held by the second holding jig 21 in a state where the region R2 of the other flange portion 3*b* where the external electrode is to be formed projects from the holding surface (main surface) 21*a* of the second holding jig 21 (transfer step).

(e) Next, in the same manner as the above-mentioned embodiment 1, as shown in FIG. 7, the second holding jig 21 which holds the core member 1 in a mode described above is inverted, and the region R2 of the other flange portion 3*b* where the external electrode is to be formed and projects downward from the holding surface 21*a* of the second holding jig 21 is brought into contact with a conductive paste (an electrode material for forming the external electrode) 15 held on the table 16 so that the electrode material (conductive paste) 15 is applied (by coating and drying) to the region R2 of the other flange portion 3*b* where the external electrode is to be formed (second electrode applying step).

Then, after applying the conductive paste to the region R1 of the one flange portion 3*a* where the external electrode is to be formed and the region R2 of the other flange portion 3*b* where the external electrode is to be formed as described above, the core member is fired so that the conductive paste is glazed whereby it is possible to acquire the core member 1 provided with a pair of external electrodes 4*a*, 4*b* having a predetermined shape on the one flange portion 3*a* and the other flange portion 3*b*.

Then, by winding the winding 5 on the winding core portion 2 of the core member 1 and connecting both ends of the winding 5 to the external electrodes 4*a*, 4*b* by soldering or the like, it is possible to acquire the winding-type coil component 10 having the structure shown in FIG. 1.

According to the method of manufacturing a winding-type coil component of embodiment 3, the core member can be rotated about the axis of the winding core portion without using the rotating jig and hence, it is possible to realize the simplification of manufacturing steps simultaneously with the simplification of the configuration of a manufacturing facility.

According to the method of manufacturing a winding-type coil component of embodiment 3, the method can acquire substantially the same advantageous effects as the method of manufacturing a winding-type coil component of the above-mentioned embodiment 1 also with respect to other points.

Embodiment 4

In the above-mentioned embodiments 1 to 3, by rotating the core member 1 about the axis 2*a* of the winding core portion 2 by 180°, the winding-type coil component is manufactured where the external electrode formed on the one flange portion and the external electrode formed on the other flange portion respectively have the structure that the upper side of the external electrode is inclined on the side surfaces of the one flange portion and the other flange portion. However, in rotating the core member 1, as shown in FIG. 11, assuming a direction of the axis 2*a* of the winding core portion 2 of the core member 1 as X and a direction perpendicular to the holding surface 11*a* or 21*a* of the first holding jig 11 or the second holding jig 21 on which the core member 1 is held as Y, the core member 1 can be configured to be rotatable such that an axis 2*a* of the winding core portion 2 is rotated on a plane defined by X and the Y (a plane corresponding to a surface of paper on which FIG. 11 is drawn) so as to change an angle between the axis of the winding core portion and the holding surface 11*a* or 21*a* (see FIG. 12).

Figure 11:
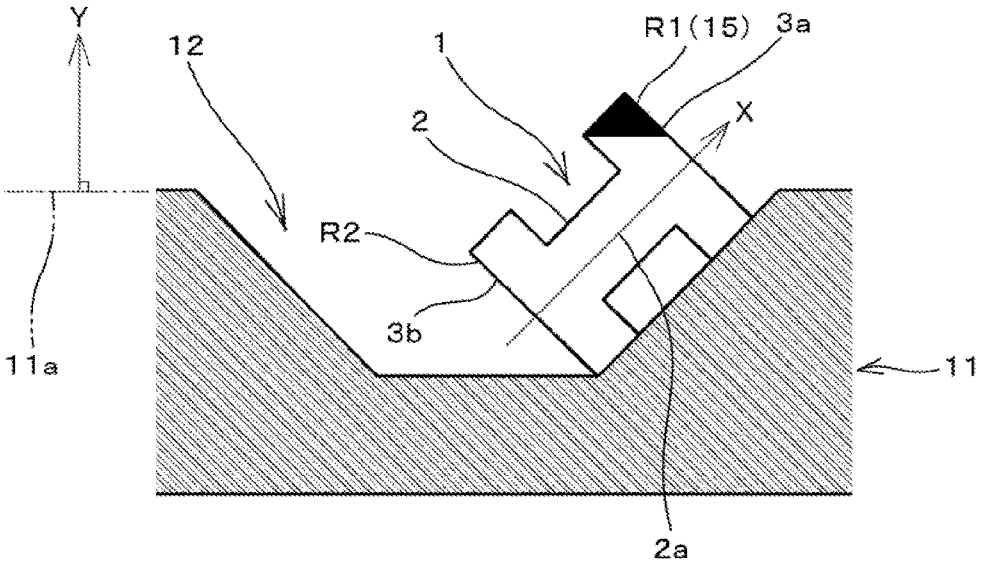
FIG. 11 is a view for describing a method of rotating a winding-type coil component in one step of a method of manufacturing a winding-type coil component according to an embodiment 4 of the present disclosure, and is also a view showing a state before the winding-type coil component is rotated.
Figure 12:
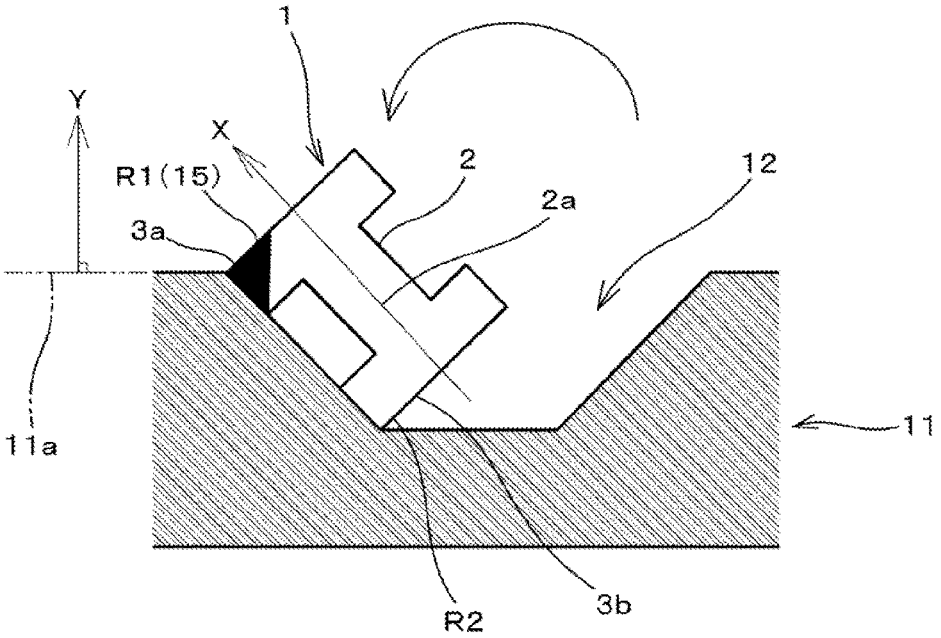
FIG. 12 is a view for describing a method of rotating the winding-type coil component in one step of the method of manufacturing a winding-type coil component according to embodiment 4 of the present disclosure, and is also a view showing a state after the winding-type coil component is rotated.

FIG. 11 and FIG. 12 show the core member 1 in a state where the conductive paste 15 is applied by coating to the region R1 of the one flange portion 3*a* where the external electrode is to be formed respectively. FIG. 11 shows the core member 1 in the state before the core member 1 is rotated using a rotating jig (not shown) on the groove portion 12 formed in the first holding jig 11 as described above, and FIG. 12 shows the core member 1 in the state after the core member 1 is rotated using the rotating jig on the groove portion 12 formed on the first holding jig 11.

Figure 13:
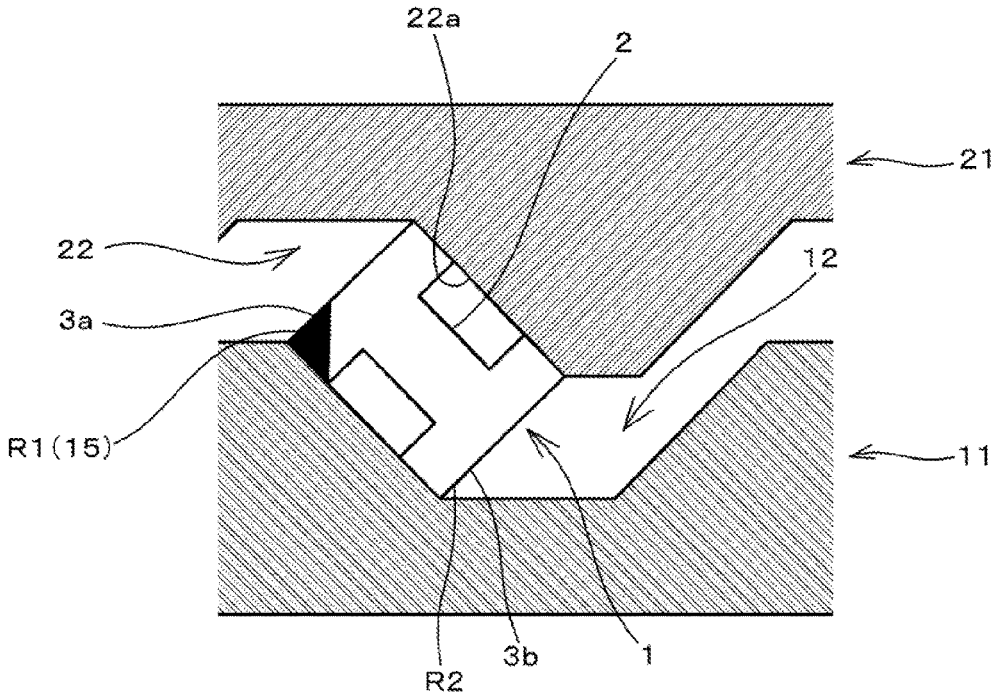
FIG. 13 is a view for describing a method of transferring the rotated winding-type coil component to a second holding jig in one step of the method of manufacturing a winding-type coil component according to embodiment 4 of the present disclosure.
Figure 14:
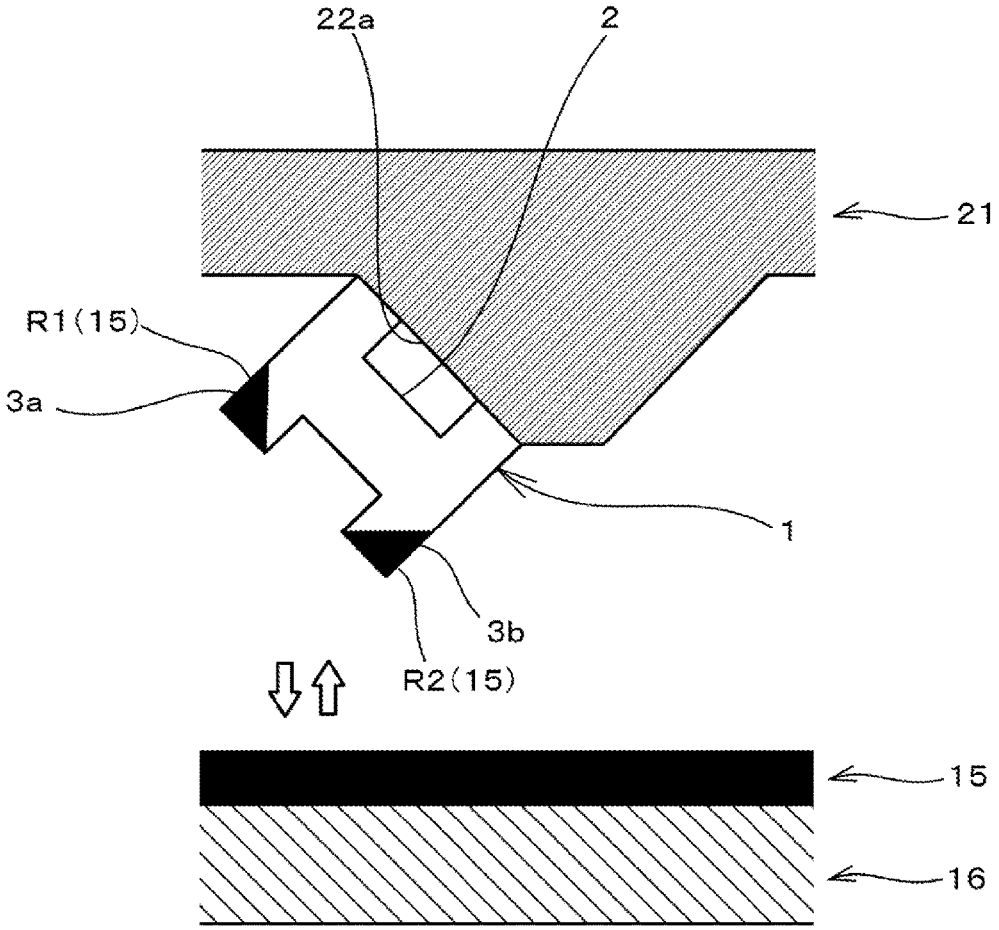
FIG. 14 is a view showing a state where an electrode material is applied to a region of the other flange portion of a core member where an external electrode is to be formed in one step of a method of manufacturing a winding-type coil component according to embodiment 4 of the present disclosure.
Figure 15:
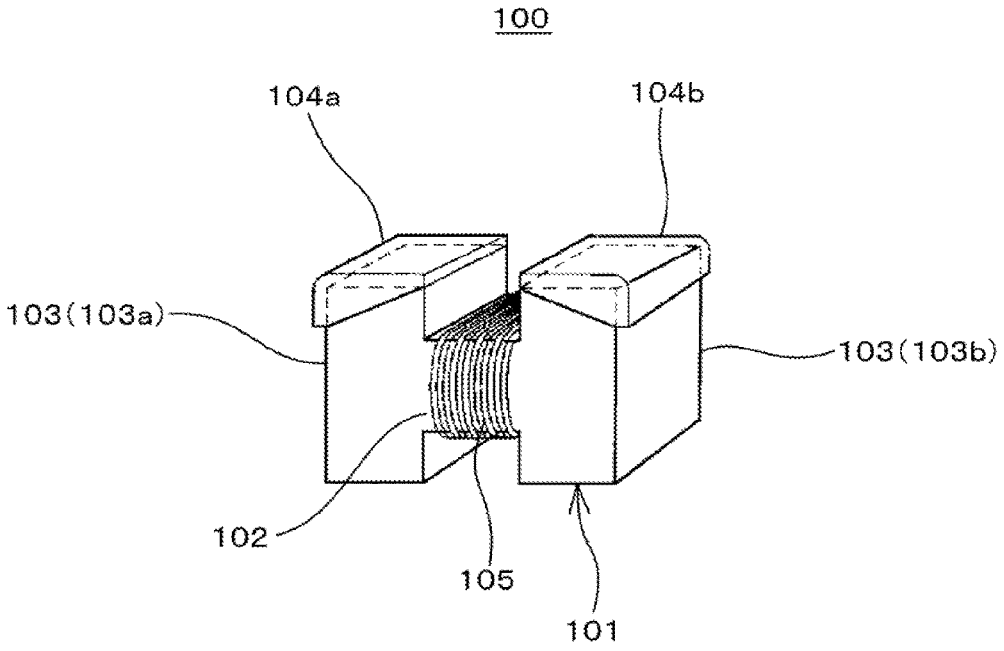
FIG. 15 is a view showing a winding-type coil component manufactured by a conventional method of manufacturing a winding-type coil component.
Figure 16:
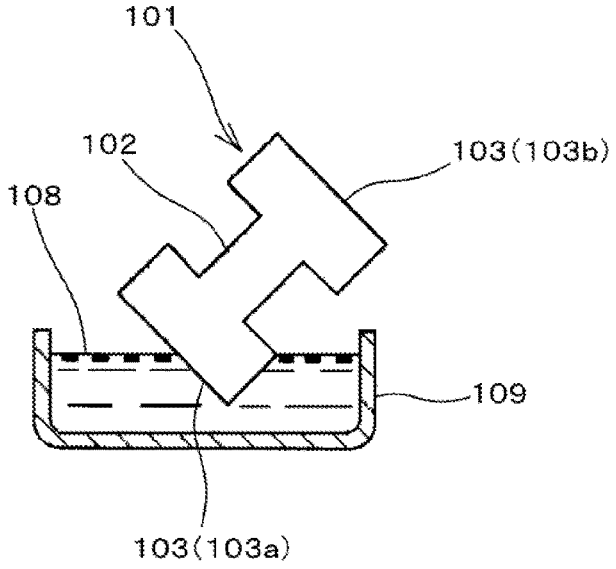
FIG. 16 is a view showing a method of manufacturing a winding-type coil component shown in FIG. 15.

Then, as shown in FIG. 13, the core member 1 held by the first holding jig 11 is rotated and, thereafter, the second holding jig 21 is brought into contact with the core member 1 and the core member 1 is transferred to the second holding jig 21 from the first holding jig 11. As shown in FIG. 14, in a state where the core member 1 is held by the second holding jig 21, the downwardly projecting region R2 of the other flange portion 3*b* where the external electrode is to be formed is brought into contact with a conductive paste (an electrode material for forming the external electrode) 15 held on the table 16 so that the conductive paste 15 can be also applied (by coating) to the region R2 of the other flange portion 3*b* where the external electrode is to be formed.

In place of the method of rotating the core member about the axis of the winding core portion described in embodiments 1 to 3, it is also possible to apply the method of embodiment 4 where the axis of the winding core portion of the core member is rotated thus rotating the core member such that an angle of the axis changes with respect to the holding surface, to the above-mentioned embodiments 1 to 3. Also in this case, the winding-type coil component 10 shown in FIG. 1 can be manufactured efficiently.

In the above-mentioned respective embodiments, the first and second holding jigs are configured to include the groove portion having inclined surfaces. However, it is also possible to use the first and second holding jigs which include inclined portions instead of groove portions. Further, depending on cases, it is possible to use the first and second holding jigs which are made of a material having a holding surface which is usually flat and is deformed when pressed.

The present disclosure is not limited to the above-mentioned embodiments in other points, and various modifications and variations can be added without departing from the gist of the present disclosure with respect to the specific configuration of the core member, the specific configurations of the first and second holding jigs, and the rotating jig and the like.

The invention claimed is:

1. A method of manufacturing a winding-type coil component which includes:

a core member having a columnar winding core portion and a pair of flange portions which are formed on both ends of the winding core portion;

a pair of external electrodes formed on one flange portion and the other flange portion of the pair of flange portions; and a winding wound on the winding core portion, wherein the external electrodes are formed on regions of the one flange portion and the other flange portion near an object on which the winding-type coil component is to be mounted such that a height of the external electrodes is gradually increased in an inclined manner from opposedly facing surfaces of the one flange portion and the other flange portion to surfaces of the one flange portion and the other flange portion on a side opposite to the opposedly facing surfaces, wherein the method comprises:

(a) a holding step of holding the core member by a first holding jig having a holding force for holding a plurality of the core members in a posture where an axis of the winding core portion has a predetermined angle with respect to a holding surface which is a main surface of the first holding jig on a side where the core member is held, and a region of the one flange portion where the external electrode is to be formed projects more from the holding surface of the first holding jig than the other flange portion, (b) a first electrode applying step of, by performing the step (a), applying an electrode material for forming the external electrode to the region of the one flange portion where the external electrode is to be formed by bringing the region of the one flange portion into contact with the electrode material, the region of the one flange portion where the external electrode is to be formed and which is projecting from the holding surface;

(c) a rotating step of, after performing the step (b), bringing a rotating jig for rotating the core member into contact with the core member held by the first holding jig, and rotating the core member by moving the rotating jig relative to the first holding jig in a direction along a main surface of the first holding jig such that a region of the other flange portion where the external electrode is to be formed opposedly faces the first holding jig;

(d) a transferring step of, after performing the step (c), transferring the core member held by the first holding jig to a second holding jig which is positioned such that the second holding jig faces the first holding jig and which has a holding force for holding the core member, and holding the core member by the second holding jig in a posture where the axis of the winding core portion has a predetermined angle with respect to a holding surface which is a main surface of the second holding jig on a side where the core member is held, and a region of the other flange portion where the external electrode is to be formed projects more from the holding surface of the second holding jig than the one flange portion, and (e) a second electrode applying step of, by performing the step (d), applying an electrode material for forming the external electrode to the region of the other flange portion where the external electrode is to be formed by bringing the region of the other flange portion into contact with the electrode material, the region of the other flange portion where the external electrode is to be formed and which is projecting from the holding surface of the second holding jig.

2. The method of manufacturing a winding-type coil component according to claim 1, wherein the rotating jig has the structure where a coating layer is disposed on a surface of a rigid body material, the coating layer being made of a material which has a friction resistance capable of rotating the core member in the rotating step and elasticity.

3. The method of manufacturing a winding-type coil component according to claim 1, wherein in the rotating step, the core member is rotated 180° about an axis of the winding core portion.

4. The method of manufacturing a winding-type coil component according to claim 1, wherein in the rotating step, assuming an axial direction of the winding core portion of the core member as X and a direction perpendicular to the holding surface of one of the first holding jig and the second holding jig on which the core member is held as Y, the core member is configured to be rotatable such that an axis of the winding core portion is rotated on a plane defined by the X and the Y so as to change an angle between the axis of the winding core portion and the holding surface.

5. The method of manufacturing a winding-type coil component according to claim 1, wherein a holding force of the second holding jig is larger than a holding force of the first holding jig.

6. The method of manufacturing a winding-type coil component according to claim 1, wherein the first holding jig and the second holding jig detachably hold the core member by an adhesive force.

7. The method of manufacturing a winding-type coil component according to claim 1, wherein the holding surfaces of the first holding jig and the second holding jig which hold the core member have an inclined portion or a groove portion having inclined side surfaces such that the core member can be held in a state where the axis of the winding core portion has a predetermined angle with respect to the holding surfaces of the first holding jig and the second holding jig.

8. A method of manufacturing a winding-type coil component which includes:

a core member having a columnar winding core portion and a pair of flange portions which are formed on both ends of the winding core portion;

a pair of external electrodes formed on one flange portion and the other flange portion of the pair of flange portions; and a winding wound on the winding core portion, wherein the external electrodes are formed on regions of the one flange portion and the other flange portion near an object on which the winding-type coil component is to be mounted such that a height of the external electrodes is gradually increased in an inclined manner from opposedly facing surfaces of the one flange portion and the other flange portion to surfaces of the one flange portion and the other flange portion on a side opposite to the opposedly facing surfaces, wherein the method comprises:

(a) a holding step of holding the core member by a first holding jig having a holding force for holding a plurality of the core members in a posture where an axis of the winding core portion has a predetermined angle with respect to a holding surface which is a main surface of the first holding jig on a side where the core member is held, and a region of the one flange portion where the external electrode is to be formed projects more from the holding surface of the first holding jig than the other flange portion, (b) a first electrode applying step of applying an electrode material for forming the external electrode to the region of the one flange portion where the external electrode is to be formed and which is projecting from the holding surface by bringing the region of the one flange portion where the external electrode is to be formed into contact with the electrode material;

(c) a transferring step of, after performing the step (b), transferring the core member held by the first holding jig to a second holding jig which is positioned such that the second holding jig faces the first holding jig and which has a holding force for holding the core member, and holding the core member by the second holding jig in a posture where the axis of the winding core portion has a predetermined angle with respect to a holding surface which is a main surface of the second holding jig on a side where the core member is held, and a region of the one flange portion where the electrode material is applied faces the second holding jig, (d) a rotating step of, after performing the step (c), bringing a rotating jig for rotating the core member about an axis of the winding core portion into contact with the core member held by the second holding jig, and rotating the core member by moving the rotating jig relative to the second holding jig in a direction along a main surface of the second holding jig, and bringing the core member into a state where a region of the other flange portion where the external electrode is to be formed projects more from the holding surface of the second holding jig than the one flange portion; and (e) a second electrode applying step of, by performing the step (d), applying an electrode material for forming the external electrode to the region of the other flange portion where the external electrode is to be formed by bringing the region of the other flange portion into contact with the electrode material, the region of the other flange portion where the external electrode is to be formed and which is projecting from the holding surface of the second holding jig.

9. The method of manufacturing a winding-type coil component according to claim 8, wherein the rotating jig has the structure where a coating layer is disposed on a surface of a rigid body material, the coating layer being made of a material which has a friction resistance capable of rotating the core member in the rotating step and elasticity.

10. The method of manufacturing a winding-type coil component according to claim 8, wherein in the rotating step, the core member is rotated 180° about an axis of the winding core portion.

11. The method of manufacturing a winding-type coil component according to claim 8, wherein a holding force of the second holding jig is larger than a holding force of the first holding jig.

12. The method of manufacturing a winding-type coil component according to claim 8, wherein the first holding jig and the second holding jig detachably hold the core member by an adhesive force.

13. The method of manufacturing a winding-type coil component according to claim 8, wherein the holding surfaces of the first holding jig and the second holding jig which hold the core member have an inclined portion or a groove portion having inclined side surfaces such that the core member can be held in a state where the axis of the winding core portion has a predetermined angle with respect to the holding surfaces of the first holding jig and the second holding jig.

14. A method of manufacturing a winding-type coil component which includes:

a core member having a columnar winding core portion and a pair of flange portions which are formed on both ends of the winding core portion;

a pair of external electrodes formed on one flange portion and the other flange portion of the pair of flange portions; and a winding wound on the winding core portion, wherein the external electrodes are formed on regions of the one flange portion and the other flange portion near an object on which the winding-type coil component is to be mounted such that a height of the external electrodes is gradually increased in an inclined manner from opposedly facing surfaces of the one flange portion and the other flange portion to surfaces of the one flange portion and the other flange portion on a side opposite to the opposedly facing surfaces, wherein the method comprises:

(a) a holding step of holding the core member by a first holding jig having a holding force for holding a plurality of the core members in a posture where an axis of the winding core portion has a predetermined angle with respect to a holding surface which is a main surface of the first holding jig on a side where the core member is held, and a region of the one flange portion where the external electrode is to be formed projects more from the holding surface of the first holding jig than the other flange portion, (b) a first electrode applying step of, by performing the step (a), applying an electrode material for forming the external electrode to the region of the one flange portion where the external electrode is to be formed by bringing the region of the one flange portion into contact with the electrode material, the region of the one flange portion where the external electrode is to be formed and which is projecting from the holding surface;

(c) a rotating step of, after performing the step (b), pressing the core member held by the first holding jig to a second holding jig which is positioned such that the second holding jig faces the first holding jig and which has a holding force for holding the core member, and rotating the core member by moving the second holding jig relative to the first holding jig in a direction along a main surface of the first holding jig such that an axis of the winding core portion has a predetermined angle with respect to the holding surface of the second holding jig, and a region of the other flange portion where the external electrode is to be formed is brought into a state where the region projects more from the holding surface of the second holding jig than the one flange portion;

(d) a transferring step of, after performing the step (c), separating the first holding jig, and bringing a state where an axis of the winding core portion has a predetermined angle with respect to the holding surface of the second holding jig, and a region of the other flange portion where the external electrode is to be formed is brought into a state where the core member is held by the second holding jig in a state where the region projects from the holding surface of the second holding jig; and (e) a second electrode applying step of, by performing the step (d), applying an electrode material for forming the external electrode to the region of the other flange portion where the external electrode is to be formed by bringing the region of the other flange portion into contact with the electrode material, the region of the other flange portion where the external electrode is to be formed and which is projecting from the holding surface of the second holding jig.

15. The method of manufacturing a winding-type coil component according to claim 14, wherein in the rotating step, the core member is rotated 180° about an axis of the winding core portion.

16. The method of manufacturing a winding-type coil component according to claim 8, wherein in the rotating step, assuming an axial direction of the winding core portion of the core member as X and a direction perpendicular to the holding surface of one of the first holding jig and the second holding jig on which the core member is held as Y, the core member is configured to be rotatable such that an axis of the winding core portion is rotated on a plane defined by the X and the Y so as to change an angle between the axis of the winding core portion and the holding surface.

17. The method of manufacturing a winding-type coil component according to claim 14, wherein in the rotating step, assuming an axial direction of the winding core portion of the core member as X and a direction perpendicular to the holding surface of one of the first holding jig and the second holding jig on which the core member is held as Y, the core member is configured to be rotatable such that an axis of the winding core portion is rotated on a plane defined by the X and the Y so as to change an angle between the axis of the winding core portion and the holding surface.

18. The method of manufacturing a winding-type coil component according to claim 14, wherein a holding force of the second holding jig is larger than a holding force of the first holding jig.

19. The method of manufacturing a winding-type coil component according to claim 14, wherein the first holding jig and the second holding jig detachably hold the core member by an adhesive force.

20. The method of manufacturing a winding-type coil component according to claim 14, wherein the holding surfaces of the first holding jig and the second holding jig which hold the core member have an inclined portion or a groove portion having inclined side surfaces such that the core member can be held in a state where the axis of the winding core portion has a predetermined angle with respect to the holding surfaces of the first holding jig and the second holding jig.

* * * * *